US011975246B2

(12) United States Patent
Greer et al.

(10) Patent No.: US 11,975,246 B2
(45) Date of Patent: May 7, 2024

(54) GOLF CLUB HEADS WITH REINFORCING MEMBER

(71) Applicant: KARSTEN MANUFACTURING CORPORATION, Phoenix, AZ (US)

(72) Inventors: Evan R. Greer, Peoria, AZ (US); Cole D. Brubaker, Scottsdale, AZ (US); Joshua A. Degerness, Scottsdale, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 18/054,522

(22) Filed: Nov. 10, 2022

(65) Prior Publication Data

US 2023/0145837 A1 May 11, 2023

Related U.S. Application Data

(60) Provisional application No. 63/345,382, filed on May 24, 2022, provisional application No. 63/263,870, filed on Nov. 10, 2021.

(51) Int. Cl.
*A63B 53/00* (2015.01)
*A63B 53/04* (2015.01)

(52) U.S. Cl.
CPC ..... *A63B 53/0454* (2020.08); *A63B 53/0458* (2020.08)

(58) Field of Classification Search
CPC ..... A63B 53/0454; A63B 53/0458
See application file for complete search history.

(56) References Cited

U.S. PATENT DOCUMENTS

| | | | |
|---|---|---|---|
| 4,928,972 | A | 5/1990 | Nakanishi |
| 5,048,835 | A | 9/1991 | Gorman |
| D327,308 | S | 6/1992 | Antonious |
| D327,520 | S | 6/1992 | Antonious |
| 5,290,032 | A | 3/1994 | Fenton |
| 5,328,184 | A | 7/1994 | Antonious |
| 6,015,354 | A | 1/2000 | Ahn |
| 6,077,173 | A | 6/2000 | Stites |
| 6,450,897 | B2 | 9/2002 | Stites |
| 6,454,665 | B2 | 9/2002 | Antonious |
| 6,773,361 | B1 | 8/2004 | Lee |
| 6,852,038 | B2 | 2/2005 | Yabu |

(Continued)

FOREIGN PATENT DOCUMENTS

| | | |
|---|---|---|
| JP | 4358377 | 3/2001 |
| JP | 4159765 | 3/2003 |

(Continued)

OTHER PUBLICATIONS

Web Page <https://www.golfwrx.com/420618/review-callaway-gbb-epic-and-epic-sub-zero-drivers/>, p. 3, Jan. 4, 2017.

(Continued)

*Primary Examiner* — Raeann Gorden

(57) ABSTRACT

Described herein is a golf club head comprising reinforcement members. The reinforcement members span across a rear cavity to connect to at least two portions of the perimeter of the club head and do not touch the rear surface of the strike face. The reinforcement members can be integrally casted or separately formed and attached to the club head. The reinforcement members improve the sound and vibrational response of the club head.

20 Claims, 10 Drawing Sheets

(56) References Cited

U.S. PATENT DOCUMENTS

| | | | |
|---|---|---|---|
| 6,918,840 | B2 | 7/2005 | Stites |
| D554,215 | S | 10/2007 | Ruggiero |
| 7,476,162 | B2 | 1/2009 | Stites |
| 7,662,050 | B2 | 2/2010 | Gilbert |
| 7,749,100 | B2 | 7/2010 | Tavares |
| D621,893 | S | 8/2010 | Nicolette |
| D635,627 | S | 4/2011 | Nicolette |
| 7,935,000 | B2 | 5/2011 | Stites |
| 7,963,860 | B2 | 6/2011 | Tavares |
| D641,446 | S | 7/2011 | Engel |
| D643,492 | S | 8/2011 | Nicolette |
| D651,268 | S | 12/2011 | Nicolette |
| 8,187,117 | B2 | 5/2012 | Blumenkrantz |
| 8,202,174 | B2 | 6/2012 | Breier |
| D663,369 | S | 7/2012 | Foster |
| 8,267,807 | B2 | 9/2012 | Takechi |
| 8,317,635 | B2 | 11/2012 | Gilbert |
| D672,830 | S | 12/2012 | Voshall |
| 8,348,782 | B2 | 1/2013 | Park |
| 8,409,031 | B2 | 4/2013 | Stites |
| 8,449,408 | B2 | 5/2013 | Clausen |
| 8,506,423 | B2 | 8/2013 | Oldknow |
| 8,876,630 | B2 | 11/2014 | Takechi |
| 8,920,261 | B2 | 12/2014 | Taylor |
| 8,939,848 | B2 | 1/2015 | Soracco |
| D730,466 | S | 5/2015 | Seagram |
| 9,138,622 | B1 | 9/2015 | Demille |
| D763,986 | S | 8/2016 | Cardani |
| 9,517,393 | B2 | 12/2016 | Cardani |
| 9,675,852 | B2 | 6/2017 | Westrum |
| D793,506 | S | 8/2017 | Cardani |
| 9,757,629 | B2 | 9/2017 | Seluga |
| 9,776,058 | B2 | 10/2017 | Seluga |
| 9,821,199 | B1 | 11/2017 | Seluga |
| 9,849,355 | B2 | 12/2017 | Seagram |
| 9,931,550 | B1 | 4/2018 | Seluga |
| 9,987,527 | B1 | 6/2018 | Myers |
| 10,010,771 | B2 | 7/2018 | Seluga |
| 10,022,601 | B2 | 7/2018 | Petersen |
| 10,039,965 | B1 | 8/2018 | Seluga |
| 10,065,089 | B2 | 9/2018 | Park |
| 10,071,291 | B2 | 9/2018 | Daraskavich |
| 10,183,204 | B2 | 1/2019 | Dolezel |
| 10,201,733 | B2 | 2/2019 | Seluga |
| 10,213,662 | B2 | 2/2019 | Seluga |
| 10,238,933 | B1 | 3/2019 | Seluga |
| 10,258,842 | B2 | 4/2019 | Sander |
| 10,335,652 | B2 | 7/2019 | Wallans |
| 10,357,696 | B2 | 7/2019 | Doi |
| 10,406,408 | B1 | 9/2019 | Seluga |
| 10,427,018 | B2 | 10/2019 | Taylor |
| 10,532,258 | B2 | 1/2020 | Seluga |
| D893,646 | S | 8/2020 | Issertell |
| 10,850,169 | B1 | 12/2020 | Day |
| 10,898,769 | B1 | 1/2021 | Gonczi |
| 11,083,937 | B2 | 8/2021 | Gibbs |
| 11,325,013 | B2 | 5/2022 | Hanhart |
| 2007/0117653 | A1 | 5/2007 | Yoneyama |
| 2007/0267777 | A1 | 11/2007 | Kienzle |
| 2014/0302944 | A1 | 10/2014 | Roach |
| 2015/0273287 | A1 | 10/2015 | Doi |
| 2017/0120112 | A1 | 5/2017 | Stokke |
| 2018/0056146 | A1 | 3/2018 | Franz |
| 2018/0133565 | A1 | 5/2018 | Hebreo |
| 2020/0139207 | A1 | 5/2020 | Taylor |
| 2020/0406109 | A1 | 12/2020 | Ban |
| 2021/0187366 | A1 | 6/2021 | Takahashi |
| 2021/0220709 | A1 | 7/2021 | Johnson |
| 2021/0260448 | A1 | 8/2021 | Morales |

FOREIGN PATENT DOCUMENTS

| | | |
|---|---|---|
| JP | 2007089747 | 4/2007 |
| JP | 5784949 | 3/2011 |
| JP | 2021000194 | 1/2021 |
| KR | 200149739 | 2/1997 |

OTHER PUBLICATIONS

Web Page <https://www.golfalot.com/equipment-reviews/taylormade-m5-irons-review-4145.aspx>, p. 2, Jan. 7, 2019.

GOLF CLUB HEADS WITH REINFORCING MEMBER

CROSS REFERENCE PRIORITIES

This claims the benefit of U.S. Provisional Application No. 63/263,870, filed Nov. 10, 2021; U.S. Provisional Application No. 63/345,382, filed May 24, 2022, the contents of which are fully incorporated herein by reference.

TECHNICAL FIELD

This disclosure relates generally to golf equipment and, more particularly, relates to golf club heads.

BACKGROUND

Golf clubs vibrate upon impact with a golf ball. These vibrations are typically experienced through sound and feel. Some vibrations produce undesirable sounds and feelings while other vibrations can produce highly desirable sounds and feelings. Golf club designers can adjust the vibrational response of the club head using several different parameters such as using different materials, adjusting material properties, or redistributing mass to different areas. However, club designers are typically more concerned about mass properties of the club head like moment of inertia and center of gravity position. Therefore, designers may sacrifice vibrational response to create club heads with high perimeter weighting and optimized center of gravity locations. As such, there will be areas of the club that vibrate in an undesirable manner, producing undesirable sounds and feelings.

Iron type club heads, and more specifically, cavity back irons, typically have increased mass around the perimeter and mass shifted towards the low and back portions. As such, mass may be taken from the top rail to be redistributed to these low and back portions. Accordingly, the top rail can typically be thinner than the remainder of the club head. Therefore, there is a need in the art to reinforce the top rail to improve the vibrational response while maintaining desirable mass properties.

BRIEF DESCRIPTION OF THE DRAWINGS

To facilitate further description of the embodiments, the following drawings are provided in which.

DEFINITIONS

Figure 1:
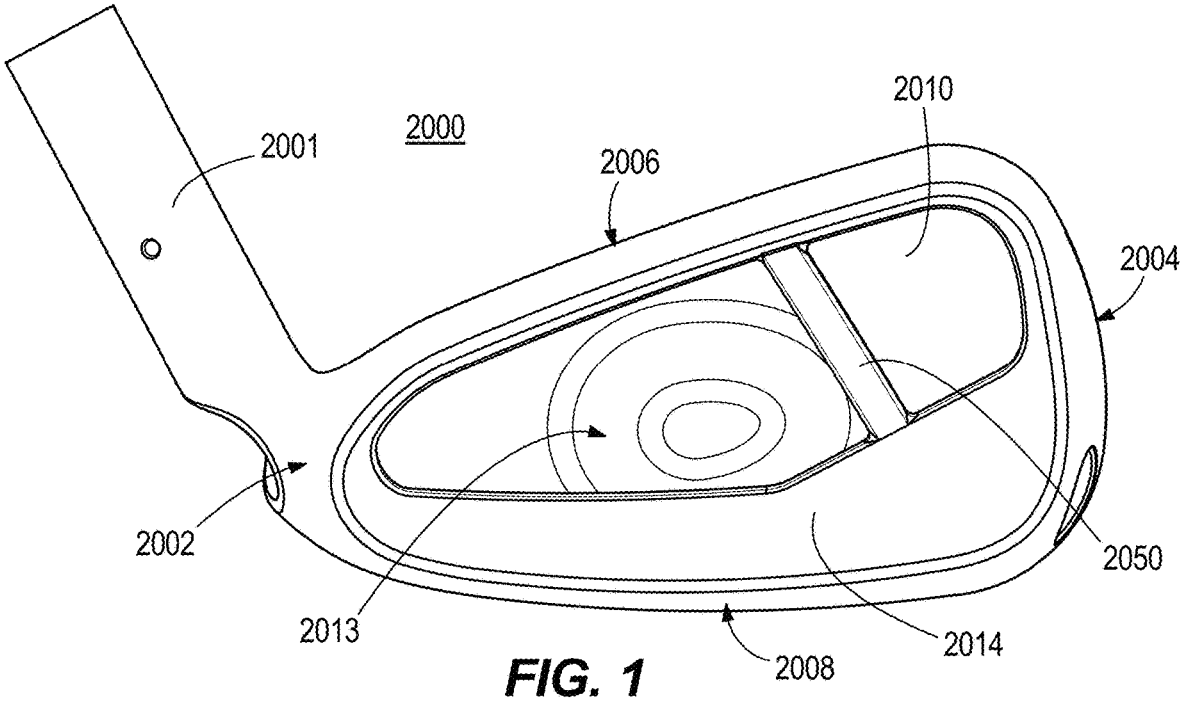
FIG. 1 illustrates a rear view of a golf club head according to an embodiment.
Figure 2:
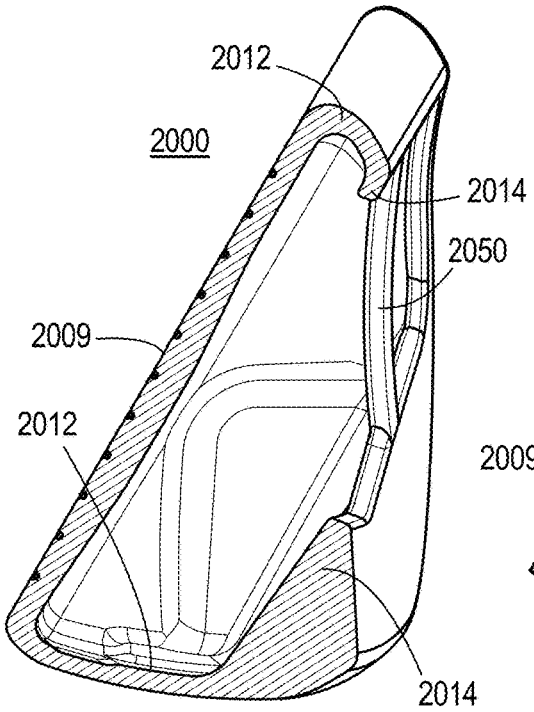
FIG. 2 illustrates a cross-sectional view of the golf club head of FIG. 1.
Figure 3:
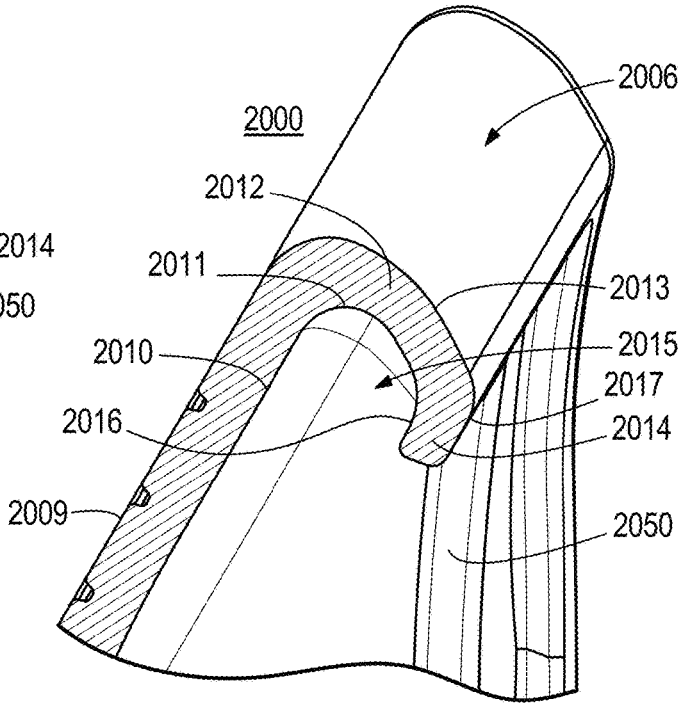
FIG. 3 illustrates a detailed cross-sectional view of the golf club head FIG. 1.
Figure 4:
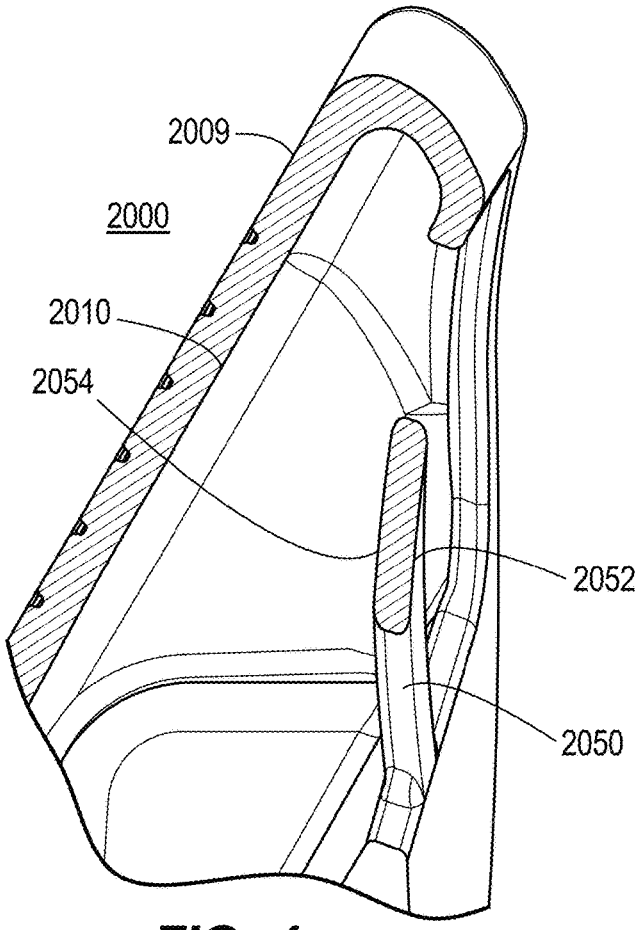
FIG. 4 illustrates a cross-sectional view of the golf club head of FIG. 1.

The terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements, mechanically or otherwise. Coupling (whether mechanical or otherwise) can be for any length of time, e.g., permanent or semi-permanent or only for an instant.

The terms "golf club head," "iron type golf club head," or "iron," as used herein, refers to an iron type golf club head. Specifically, the iron type golf club head can be a muscle back iron, a cavity back iron, a blade style iron, a hollow body iron, a cavity back muscle iron, a high moment of inertia iron, a wedge, a cast iron, a forged iron, or any other iron type golf club head. A standard set of irons can comprise a 3, 4, 5, 6, 7, 8, 9, and pitching wedge (PW).

The term "strike face," "face panel," as used herein, refers to a golf club head front surface that is configured to strike a golf ball. The term strike face can be used interchangeably with "club face," "face panel."

The term "strike face perimeter," as used herein, can refer to an edge of the strike face. The strike face perimeter can be located along an outer edge of the strike face where the curvature deviates from a bulge and/or roll of the strike face.

The terms "geometric centerpoint," "geometric center," "face center," as used herein, can refer to a geometric centerpoint of the strike face perimeter, and at a midpoint of a club face height of the strike face. In the same or other examples, the geometric centerpoint also can be centered with respect to an engineered impact zone, which can be defined by a region of grooves on the strike face. In another approach, the geometric centerpoint of the strike face can be located in accordance with the definition of a golf governing body such as the United States Golf Association (USGA). For example, the geometric centerpoint of the strike face can be determined in accordance with Section 6.1 of the USGA's Procedure for Measuring the Flexibility of a Golf Clubhead (USGA-TPX3004, Rev. 1.0.0, May 1, 2008) (available at http://www.usga.org/equipment/testing/protocols/Procedure-For-Measuring-The-Flexibility-Of-A-Golf-Club-Head/) (the "Flexibility Procedure").

The term "ground plane," as used herein, can refer to a reference plane associated with the surface on which a golf ball is placed. The ground plane can be a horizontal plane tangent to a sole of a golf club head at an address position.

The term "loft plane," as used herein, can refer to a reference plane that is tangent to the geometric centerpoint of the strike face.

The terms "loft" or "loft angle" of a golf club as used herein refers to the angle formed between the strike face and the shaft, as measured by any suitable loft and lie machine.

An iron can comprise a loft angle less than approximately 60 degrees, less than approximately 59 degrees, less than approximately 58 degrees, less than approximately 57 degrees, less than approximately 57 degrees, less than approximately 56 degrees, less than approximately 55 degrees, less than approximately 54 degrees, less than approximately 53 degrees, less than approximately 52 degrees, less than approximately 51 degrees, less than approximately 50 degrees, less than approximately 49 degrees, less than approximately 48 degrees, less than approximately 47 degrees, less than approximately 46 degrees, less than approximately 45 degrees, less than approximately 44 degrees, less than approximately 43 degrees, less than approximately 42 degrees, less than approximately 41 degrees, less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, less than approximately 30 degrees, less than approximately 29 degrees, less than approximately 28 degrees, less than approximately 27 degrees, less than approximately 26 degrees, less than approximately 25 degrees, less than approximately 24 degrees, less than approximately 23 degrees, less than approximately 22 degrees, less than approximately 21 degrees, less than approximately 20 degrees, less than approximately 19 degrees or less than approximately 18 degrees.

In other embodiments, the iron can comprise a loft angle greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, greater than approximately 25 degrees, greater than approximately 26 degrees, greater than approximately 27 degrees, greater than approximately 28 degrees, greater than approximately 29 degrees, greater than approximately 30 degrees, greater than approximately 31 degrees, greater than approximately 32 degrees, greater than approximately 33 degrees, greater than approximately 34 degrees, greater than approximately 35 degrees, greater than approximately 36 degrees, greater than approximately 37 degrees, greater than approximately 38 degrees, greater than approximately 39 degrees, greater than approximately 40 degrees, greater than approximately 41 degrees, greater than approximately 42 degrees, greater than approximately 43 degrees, greater than approximately 44 degrees, greater than approximately 45 degrees, greater than approximately 46 degrees, greater than approximately 47 degrees, greater than approximately 48 degrees, greater than approximately 49 degrees, greater than approximately 50 degrees, greater than approximately 51 degrees, greater than approximately 52 degrees, greater than approximately 53 degrees, greater than approximately 54 degrees, greater than approximately 55 degrees, greater than approximately 56 degrees, greater than approximately 57 degrees, greater than approximately 58 degrees, greater than approximately 59 degrees, or greater than approximately 60 degrees.

"Volume" of an iron as used herein, can be measured as a displaced volume enclosed by an outer surface of the club head. In some embodiments, the volume of the golf club head can be less than approximately 45 cc, less than approximately 40 cc, less than approximately 35 cc, less than approximately 30 cc, or less than approximately 25 cc. The total volume of the club head can range inclusively from 30 cc and 45 cc. In other embodiments, the volume of the club head can be approximately 31 cc-38 cc (1.9 cubic inches to 2.3 cubic inches), approximately 31 cc-33 cc, approximately 33 cc-35 cc, approximately 35 cc-37 cc, approximately 37 cc-39 cc, or approximately 35 cc-45 cc. In one example, the golf club head can be 39 cc (2.4 cubic inches). The volume of the golf club head can range inclusively from 25 cc and 35 cc. In other embodiments, the volume of the club head 210 can be approximately 25 cc-30 cc (1.9 cubic inches to 2.3 cubic inches).

"Mass" of an iron as used herein, can be a mass ranging inclusively from 240 grams (g) to 400 grams (g). In one example, the mass can be 260 g. In other embodiments, mass of the golf club head can range inclusively from 230 grams (g) to 300 grams (g). In another example, the mass can be approximately 250

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements or signals, electrically, mechanically and/or otherwise.

An "XYZ" coordinate system of the golf club head, as described herein, is based upon the geometric center of the strike face. The golf club head dimensions as described herein can be measured based on a coordinate system as defined below. The geometric center of the strike face defines a coordinate system having an origin located at the geometric center of the strike face. The coordinate system defines an X axis, a Y axis, and a Z axis. The X axis extends through the geometric center of the strike face in a direction from the heel to the toe of the fairway-type club head. The Y axis extends through the geometric center of the strike face in a direction from the top rail to the sole of golf club head. The Y axis is perpendicular to the X axis. The Z axis extends through the geometric center of the strike face in a direction from the front end to the rear end of the golf club head. The Z axis is perpendicular to both the X axis and the Y axis.

The term or phrase "center of gravity position" or "CG location" can refer to the location of the club head center of gravity (CG) with respect to the XYZ coordinate system, wherein the CG position is characterized by locations along the X-axis, the Y-axis, and the Z-axis. The term "CGx" can refer to the CG location along the X-axis, measured from the origin point. The term "CG height" can refer to the CG location along the Y-axis, measured from the origin point. The term "CGy" can be synonymous with the CG height. The term "CG depth" can refer to the CG location along the Z-axis, measured from the origin point. The term "CGz" can be synonymous with the CG depth.

The XYZ coordinate system of the golf club head, as described herein defines an XY plane extending through the X axis and the Y axis. The coordinate system defines XZ plane extending through the X axis and the Z axis. The coordinate system further defines a YZ plane extending through the Y axis and the Z axis. The XY plane, the XZ plane, and the YZ plane are all perpendicular to one another and intersect at the coordinate system origin located at the geometric center of the strike face. In these or other embodiments, the golf club head can be viewed from a front view when the strike face is viewed from a direction perpendicular to the XY plane. Further, in these or other embodiments, the golf club head can be viewed from a side view or side cross-sectional view when the heel is viewed from a direction perpendicular to the YZ plane.

The golf club head further comprises a coordinate system centered about the center of gravity. The coordinate system comprises an X'-axis, a Y'-axis, and a Z'-axis. The X'-axis extends in a heel-to-toe direction. The X'-axis is positive towards the heel and negative towards the toe. The Y'-axis extends in a sole-to-top rail direction and is orthogonal to both the Z'-axis and the X'-axis. The Y'-axis is positive towards the top rail and negative towards the sole. The Z-axis extends front-to-rear, parallel to the ground plane and is orthogonal to both the X'-axis and the Y'-axis. The Z'-axis is positive towards the strike face and negative towards the rear.

The term or phrase "moment of inertia" (hereafter "MOI") can refer to values measured about the CG. The term "MOIxx" can refer to the MOI measured in the heel-to-toe direction, parallel to the X'-axis. The term "MOIyy" can refer to the MOI measured in the sole-to-top rail, parallel to the Y-axis. The term "MOIzz" can refer to the MOI measured in the front-to-back direction, parallel to the Z-axis. The MOI values MOIxx, MOIyy, and MOIzz determine how forgiving the club head is for off-center impacts with a golf ball.

In many embodiments, such as for "game improvement irons", the volume of the club head is less than approximately 65 $cm^3$, less than approximately 60 $cm^3$, less than approximately 55 $cm^3$, or less than approximately 50 $cm^3$. In some embodiments, the volume of the club head can be approximately 50 $cm^3$ to 60 $cm^3$, approximately 51 $cm^3$-53 $cm^3$, approximately 53 $cm^3$-55 $cm^3$, approximately 55 $cm^3$-57 $cm^3$, or approximately 57 $cm^3$-59 $cm^3$.

In many embodiments, such as for "player's irons", the volume of the club head is less than approximately 45 $cm^3$, less than approximately 40 $cm^3$, less than approximately 35 $cm^3$, or less than approximately 30 $cm^3$. In some embodiments, the volume of the club head can be approximately 31 $cm^3$*38 $cm^3$ (1.9 cubic inches to 2.3 cubic inches), approximately 31 $cm^3$-33 $cm^3$, approximately 33 $cm^3$-35 $cm^3$, approximately 35 $cm^3$-37 $cm^3$, or approximately 37 $cm^3$-39 $cm^3$.

In some embodiments, the iron can comprise a total mass ranging between 180 grams and 260 grams, 190 grams and 240 grams, 200 grams and 230 grams, 210 grams and 220 grams, or 215 grams and 220 grams. In some embodiments, the total mass of the club head is 215 grams, 216 grams, 217 grams, 218 grams, 219 grams, or 220 grams.

DESCRIPTION

Described herein is a golf club head comprising a reinforcing member, which spans the rear cavity and connects to at least two portions of the perimeter of the club head. The reinforcing member provides structural reinforcement to portions of the perimeter, which are more flexible or limber. By providing support to these flexible portions, the reinforcing member can reduce movement and increase frequency response, thereby improving sound and performance of the golf club head. Specifically, the reinforcing member can be used to reinforce the top rail which experiences the most movement and vibrations during impact with a golf ball. Providing structural support to the top rail, the frequency of the top rail can be increased to a desirable amplitude in dominate modes of modal analysis, thereby improving sound and feel. Furthermore, by providing structural support to the top rail, the launch and spin characteristics of the golf ball are affected. Supporting the top rail during impact will reduce dynamic lofting thereby decreasing launch angle (by approximately 0.5 degrees to 2 degrees) and lowering spin (by approximately 100-300 rpms), resulting in a gain of total distance (by approximately 3-5 yards).

In some embodiments the reinforcing member can be integrally casted with the club head such that the reinforcing member and club head are formed from the same material.

In other embodiments, the reinforcing member can be separately formed and attached to the club head. In all embodiments, the reinforcing member does not contact the rear surface of the strike face.

As mentioned above, the reinforcing member reinforces the top rail to increase the frequency of the top rail in specific modes obtained from modal analysis. Modal analysis is performed with finite element software to display a golf club heads frequency response. The software outputs a set of modes with different frequencies. Each mode shows the amplitude (using different shading) at which the club head vibrates at a certain frequency. For example, Mode 7 may show a club head with a frequency of 2500 Hz and a color map or video of the club head moving. The club head may move more (higher amplitude) in certain locations while other locations may move less (lower amplitude). However, the entire club head is vibrating at the frequency of 2500 Hz. The amplitude at which the club head vibrates is shown through color/shading or a video. For example, the top rail of a club may experience more movement (higher amplitude) and will have a red or darker appearance while the sole may experience less movement (lower amplitude) and be colored with a blue or lighter appearance. Further examples are illustrated in FIGS. 18 and 19 which show various club heads in with different shading. The darker portions of the club heads indicate higher amplitude regions (more movement) while the lighter portions of the club head indicate lower amplitude regions (less movement).

As mentioned above, modal analysis outputs a set of modes for a given structure. Each mode has a different frequency and shows how a certain structure will vibrate at the frequency. However, the vibrations produced in modal analysis are not necessarily vibrations that produce sound (pressure waves). Nonetheless, specific modes within the set of modes can correspond to, or indicate, how the structure would sound by matching the frequency of a sound with the frequency of a mode. A sound recording will typically show a graph of frequency verse amplitude. One could find the frequency at which the highest amplitude occurs from the sound, then find the mode that is close to that frequency. For example, a sound recording (of a golf club on impact with a ball) can show the highest amplitude occurring at 2500 Hz. Mode 7 of the same golf club head could have a frequency of approximately 2500 Hz. Therefore, Mode 7 could be associated with the sound produced by the golf club head and one could use Mode 7 to predict sound. Furthermore, it has been generally observed that an increase in frequency in the modes associated with sound (Mode 7 and Mode 10) improves the sound produced from the club head. As such, it is an aspect of the present invention to increase the frequency in Mode 7 and Mode 10 since Mode 7 and Mode 10 have been determined to be the modes associated with sound.

I. Integral Reinforcing Member

FIGS. 1-4 illustrate a golf club head 2000 according to an embodiment. The golf club head 2000 comprises a striking face 2009, a strike face rear surface 2010, a heel portion 2002, a toe portion 2004 opposite the heel portion 2002, a top rail 2006, a sole portion 2008 opposite the top rail 2006, and a hosel 2001 configured to receive a shaft (not shown). The club head 2000 further comprises a perimeter extension 2012, which extends rearwardly away from the perimeter of the strike face. In embodiment illustrated in FIGS. 1-4, the perimeter extension 2012 is continuous around the perimeter of the club head 2000 such that there is no discontinuity in the perimeter extension 2012. The perimeter extension 2012 increases the overall moment of inertia by distributing mass to the perimeter of the club head. The perimeter extension 2012 comprises an inner surface 2011 and an outer surface 2013. The inner surface of the perimeter extensions 2012 and the striking face rear surface 2010 define a rear cavity 2013.

The perimeter extension 2012 can extend rearwardly at various lengths at different portions of the perimeter extension 2012. For example, in the embodiment illustrated in FIGS. 1-4, the perimeter extension 2012 extends more rearwardly in the sole portion 2008 than in the top rail 2006. In other embodiments, the perimeter extension 2012 can extend more rearwardly in the toe portion 2004, heel portion 2002, or the top rail 2006.

The perimeter extension 2012 further comprises a rear wall 2014, which extends inwardly into the rear cavity 2013 such that each portion of the rear wall 2014 extends towards the opposite side of the rear wall 2014. For example, the rear wall 2014 on the top rail extends towards the sole. Similarly, the rear wall 2014 on the heel portion extends towards the toe portion. Like the perimeter extension 2012, the rear wall 2014 is continuous around the perimeter of the club head 2000. Furthermore, the rear wall 2014 extends inwardly at various lengths at different portions of the rear wall 2014. For example, in the embodiment illustrated in FIGS. 1-4, the rear wall 2014 extends more inwardly at the sole portion 2008 than the top rail portion 2006. In other embodiments, the rear wall 2014 can extend more inwardly in the heel portion 2002, the toe portion 2004, or the top rail 2006. In further embodiments, the rear wall 2014 can extend inwardly at approximately that same length at each portion of the rear wall 2014. The rear wall 2014 forms a portion of the rear. The rear wall 2014 comprises a rear inner surface 2016 and a rear outer surface 2017. The rear inner surface 2016, the perimeter extensions inner surface 2011, and the strike face rear surface 2010 define a perimeter undercut 2015.

The perimeter undercut 2015 is contained within the rear cavity 2013 such that the rear cavity 2013 comprises the perimeter undercut 2015. In other words, the rear cavity 2013 comprises the perimeter undercut 2015 and is further bounded by the rear inner surface 2016, perimeter extension inner surface 2011, and the strike face rear surface 2010. The perimeter undercut 2015 removes material and mass from the club head so that the material may be placed in more desirable locations in other areas of the club head 2000. For example, the top rail undercut removes significant amount of the mass to create a relative thin top rail. This mass may be placed in the rear and sole portions to improve the center of gravity location. The mass may also be placed in the toe and heel regions to improve the moment of inertia. The mass that is redistributed may be integral with the club head, such as a thickened region, or may be separately attached, such as a screw or attachable weight. The discretionary mass gained from the perimeter undercut 2015 can range from approximately 5 grams to 40 grams. Due to the thinness of the top rail created from the perimeter undercut 2015, it is an aspect of the present invention to reinforce the top rail.

As mentioned above, the club head 2000 further comprises a reinforcing member 2050. The reinforcing member 2050 spans the rear cavity 2013 and connects to at least two portions of the rear wall 2014. In this embodiment, the reinforcing member 2050 is integral with the club head 2000 such that the reinforcing member 2050 is the same material as, and casted with, the club head 2000. The reinforcing member 2050 provides structural support to the rear wall 2014 and the perimeter extension 2012 of the club head 2000. Specifically, the reinforcing member 2050 targets regions of the perimeter club head 2000 which experience high frequency such as the top rail 2006. The top rail 2006 experiences high frequency due to the relative size and thinness when compared to the rest of the club head. It is preferred to maintain or even reduce the size of the top rail in order to maintain a low and back center of gravity. As such, the reinforcing structure 2050 is configured to attach to at least one portion on the top rail of the rear wall. The reinforcing member 2050 works in conjunction with the perimeter undercut 2015 to create a club head 2000 that has a significant improvement in sound and vibrational responses while maintaining or improving performance and mass properties.

The removal of mass from the perimeter undercut 2015 offsets the additional mass added from the reinforcing member 2050. For example, the perimeter undercut 2015 can save approximately 2-10 grams which can be redistributed to the reinforcing member 2050. The rear cavity formed from the perimeter undercut 2015 can be made to any desired size to achieve sufficient mass savings to redistribute to the reinforcing member 2050. For example, the volume of the rear cavity created by the perimeter undercut 2015 can be increased to remove more mass from the top rail 2006 thereby lowering the overall center of gravity of the club head 2000. Similarly, the reinforcing member 2015 can be made to any desired size to adjust the center of gravity. The rear cavity volume from the perimeter undercut 2015 is balanced with the size of the reinforcing member 2050 to achieve a desired center of gravity position while stiffening the club head and improving overall sound and feel.

The reinforcing member 2050 connects to the top rail 2006 and at least one other portion of the rear wall 2014. In the illustrated embodiment of FIGS. 1-4, the reinforcing member 2050 connects to the top rail 2006 and the sole portion of the rear wall 2014. The reinforcing member 2050 is angled such that the top portion of the reinforcing member near the top rail 2006 is located more heelward than the bottom portion of the reinforcing member near the sole portion 2008. As such, the bottom portion of the reinforcing member is connected to the rear wall 2014 at the sole portion 2008, proximate the toe portion 2004. In other embodiments, the reinforcing member 2050 can connect to the top rail 2006 and other portions of the rear wall 2014. For example, the reinforcing member 2050 can connect to the top rail 2006 and the toe portion 2014 or the top rail 2006 and the heel portion 2002. The reinforcing member 2050 may also connect to three or more portions of the rear wall 2014, wherein at least one of the connections are in the top rail 2006. The reinforcing member 2050 may connect the area of the rear wall with low amplitude to an area of high amplitude (in a single mode). In all embodiments described herein, the reinforcing member 2050 does not touch the strike face rear surface 2010.

The reinforcing member 2050 comprises a front surface 2054 and a rear surface 2052 opposite the front surface 2054. The front surface 2054 is located on the front of the reinforcing member 2050 such that is located within the cavity 2013 and faces the rear surface of the striking surface and cannot be seen from an exterior view of the club head. The rear surface 2052 of the reinforcing member forms a portion of the rear of the club head 2000 and can be seen from a rear exterior view of the club head.

The reinforcing member 2050 further comprises a thickness measured as the distance between the rear surface 2052 to the front surface 2054 of the reinforcing member 2050, in a front to back direction. The thickness of the reinforcing member 2050 can range from approximately 0.030 inch to 0.250 inch. The thickness can be approximately constant throughout the length of the reinforcing member or the thickness can vary along the length. For example, the thickness of the reinforcing member can be thinner at the top near the top rail and thicker on the bottom, near the sole or the reinforcing member can be thicker at the top rail and thinner near the sole.

The reinforcement member 2050 can take on various orientations and sizes in order to tune vibrational response and sound. The reinforcement member 2050 can connect to different portions of the top rail 2006 relative to the sole 2008.

Figure 5:
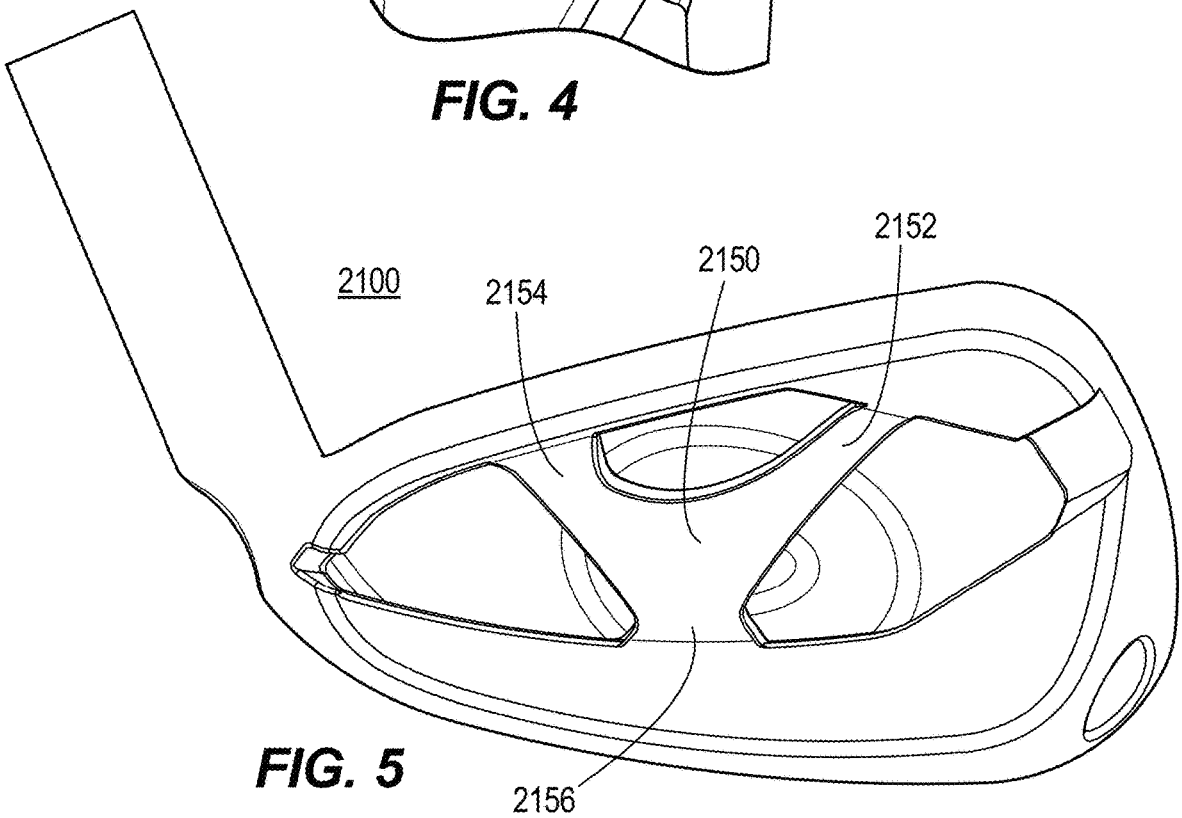
FIG. 5 illustrates a rear view of a golf club head according to an embodiment.

FIGS. 5-11 illustrate various embodiments of reinforcing members according to aspects of the invention. FIG. 5 illustrates another embodiment of a club head 2100 comprising a reinforcing member 2150. The club head 2100 is similar to the club head 2000 described above. The reinforcing member 2150 takes an approximate Y-shape configuration. Specifically, reinforcing member 2150 connects to two portions of the top rail, one in the heel portion and the other in the toe portion, and further connects to the sole portion of the rear wall. The reinforcing member 2150 comprises a heelward portion 2154, a toeward portion 2152, and a bottom portion 2156. The heelward portion 2154, the toeward portion 2152, and the bottom portion 2156 are interconnected to from a Y-shaped reinforcing member 2150. In this embodiment, the reinforcing member 2150 targets and connects to areas of the top rail on each side of the high frequency portion (i.e., the middle portion of the top rail). This configuration structural reinforces the area around the high frequency, and as such, will decrease the max frequency.

Figure 6:
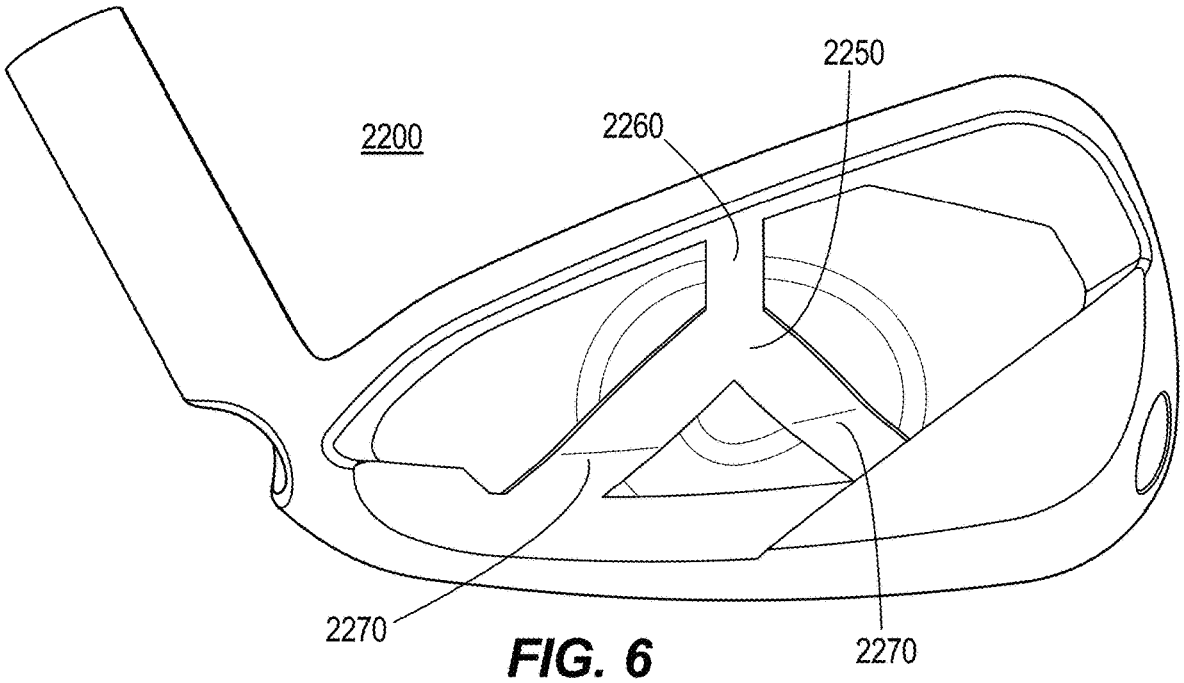
FIG. 6 illustrates a rear view of a golf club head according to an embodiment.

FIG. 6 illustrates another embodiment of a club head 2200 comprising a reinforcing member 2250. The club head 2200 is similar to the club head 2000 described above. The reinforcing member 2250 takes a general shape of an upside-down Y-shape. The reinforcing member 2250 comprises a top portion 2260 which connects to the top rail, a toeward portion 2270 which connects to the sole portion proximate the toe, and a heel portion 2280 which connects to the sole portion proximate the heel.

Figure 7:
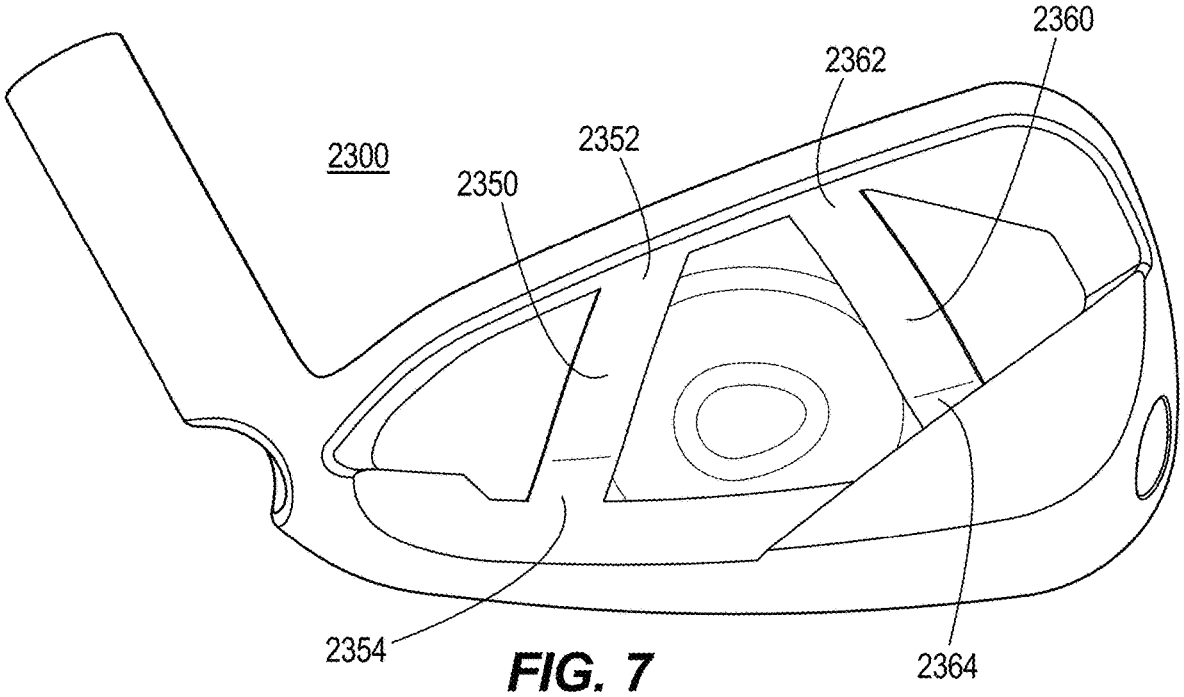
FIG. 7 illustrates a rear view of a golf club head according to an embodiment.

FIG. 7 illustrates another embodiment of a club head 2300 comprising reinforcing members 2350, 2360. The club head 2300 is similar to the club head 2000 described above. The first reinforcing member 2350 is located on the heel side of the cavity and the second reinforcing member 2360 is located on the toe side of the cavity. The first reinforcing member 2350 is separate and distinct from the second reinforcing member 2360 such that they do not connect to each other. In this embodiment, the first and second reinforcing members are approximately straight. Furthermore, they are not parallel to each other such that a longitudinal axis running through the length of each of the members would intersect above the club head.

Figure 8:
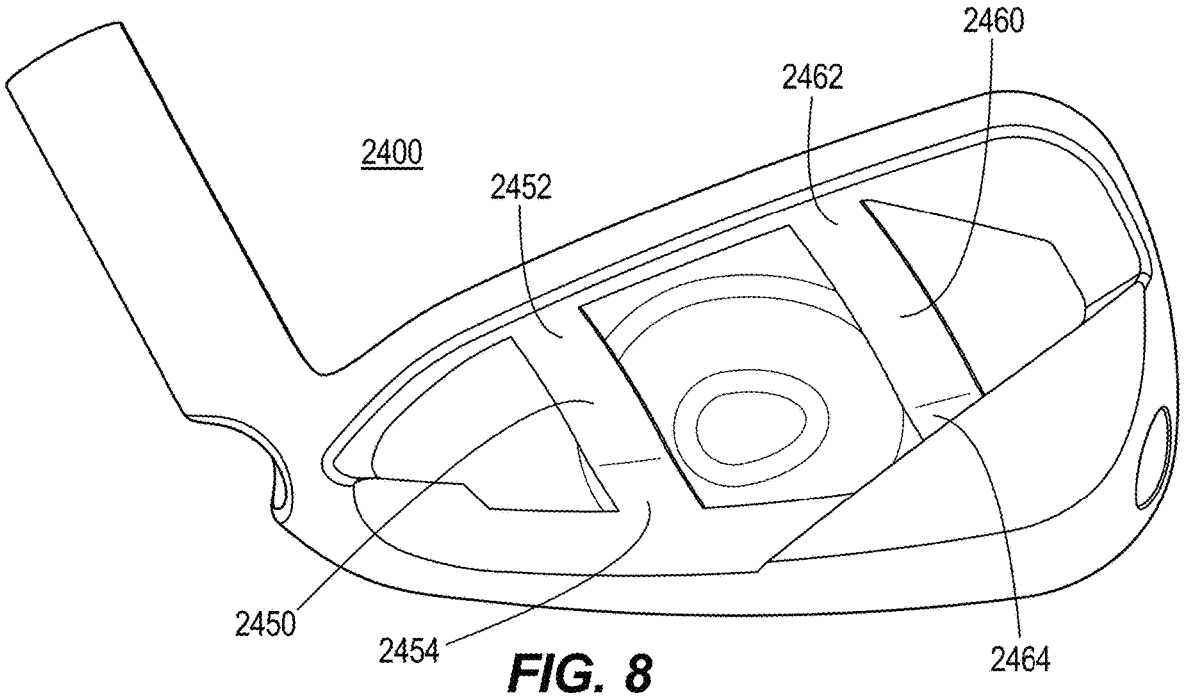
FIG. 8 illustrates a rear view of a golf club head according to an embodiment.

FIG. 8 illustrates another embodiment of a club head 2400 comprising reinforcing members 2450, 2460. The club head 2400 is similar to the club head 2000 described above. The first reinforcing member 2450 and second reinforcing member 2460 are separate and distinct reinforcing members that are approximately parallel to each other. The first and second reinforcing members 2450, 2460 are angled such that the bottom portion of each member are located more toeward than the top portion of the member. The first and second reinforcing members 2450, 2460 can be spaced any desired distance apart in order to achieve desired damping and mass property adjustment.

Figure 9:
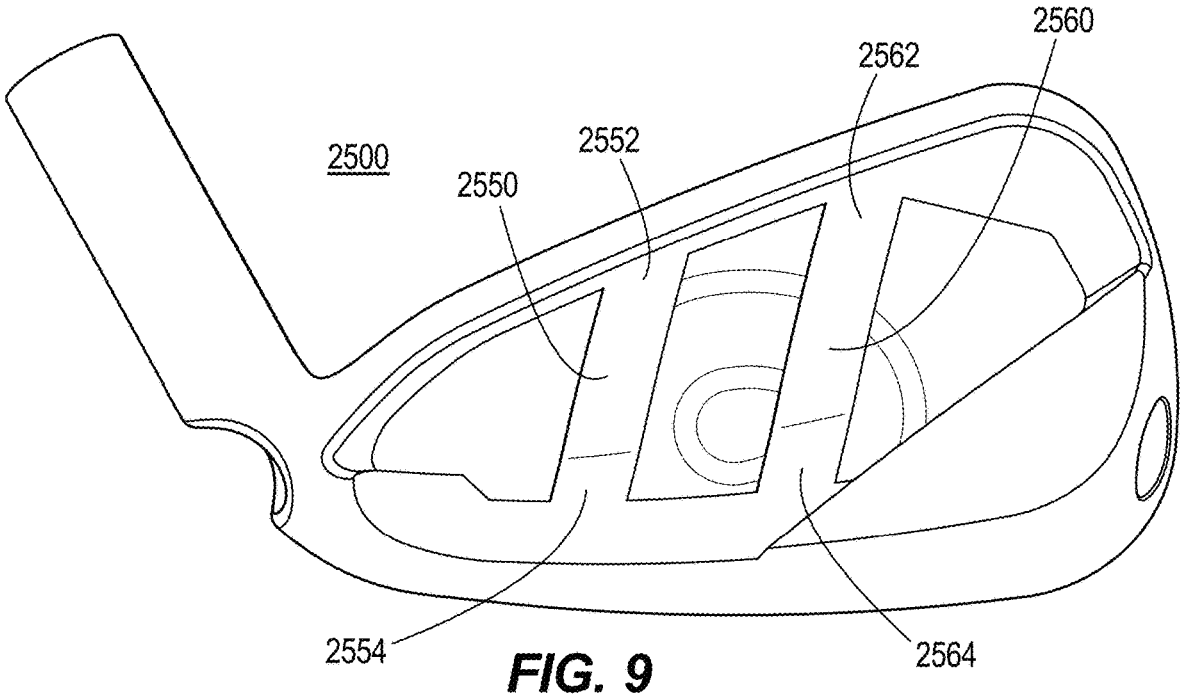
FIG. 9 illustrates a rear view of a golf club head according to an embodiment.

FIG. 9 illustrates another embodiment of a club head 2500 comprising reinforcing members 2550, 2560. The club head 2500 is similar to the club head 2000 described above. The first reinforcing member 2550 and the second reinforcing member 2560 are separate and distinct reinforcing members that are approximately parallel to each other. The first and second reinforcing members 2550, 2560 are angled such that the bottom portion of each member are located more heelward than the top portion of the member. The first and second reinforcing members 2550, 2560 can be spaced any desired distance apart in order to achieve desired damping and mass property adjustment.

Figure 10:
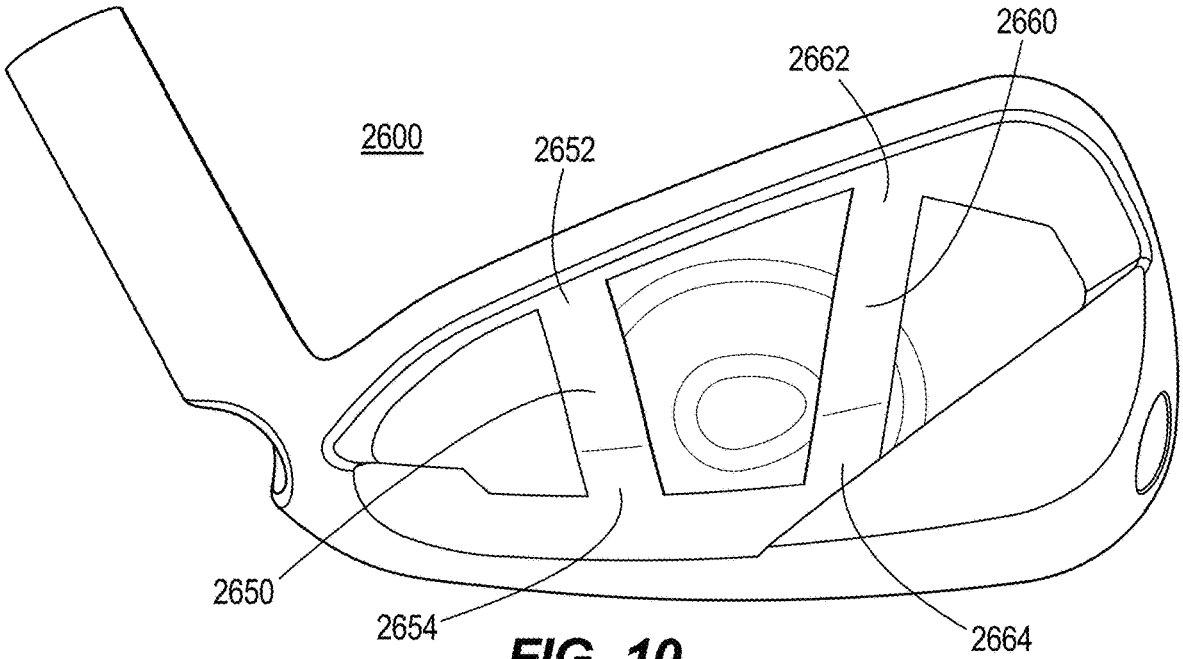
FIG. 10 illustrates a rear view of a golf club head according to an embodiment.

FIG. 10 illustrates another embodiment of a club head 2600 comprising reinforcing members 2650, 2660. The club head 2600 is similar to the club head 2000 described above. The first reinforcing member 2650 is located on the heel side of the cavity and the second reinforcing member 2660 is located on the toe side of the cavity. The first reinforcing member 2650 is separate and distinct from the second reinforcing member 2660 such that they do not connect to each other. In this embodiment, the first and second reinforcing members 2650, 2660 are approximately straight. Furthermore, the first and second reinforcing members 2650, 2660 are not parallel to each other such that a longitudinal axis running through the length of each of the members would intersect below the club head.

Figure 11:
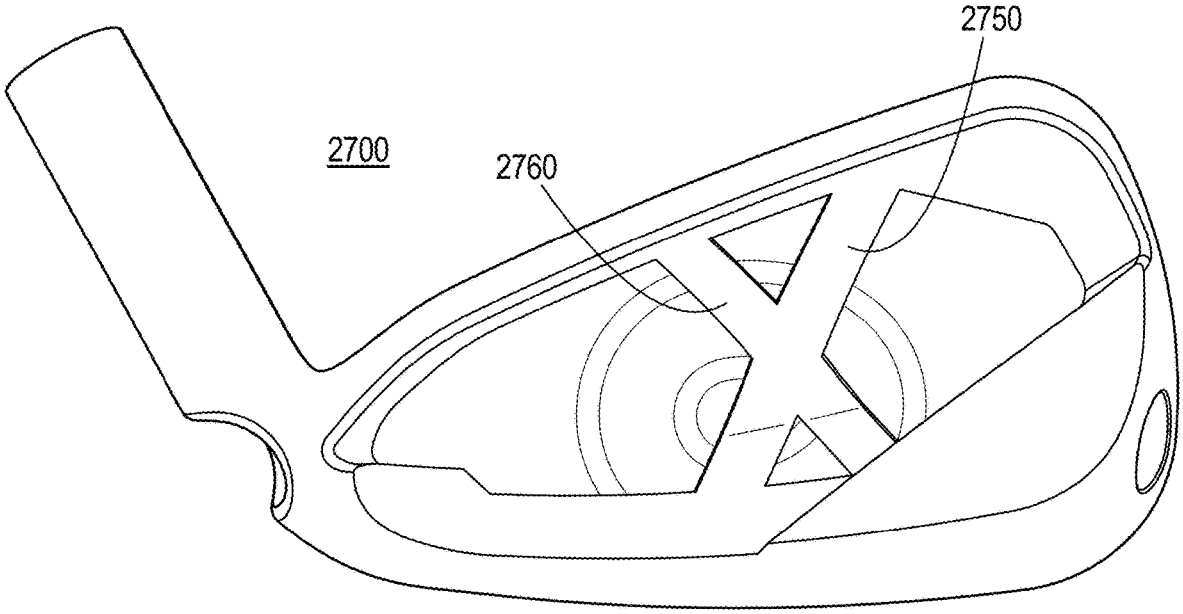
FIG. 11 illustrates a rear view of a golf club head according to an embodiment.

FIG. 11 illustrates another embodiment of a club head 2700 comprising reinforcing members 2750, 2760. The club head 2700 is similar to the club head 2000 described above. The first reinforcing member 2750 intersects the second reinforcing member 2760 in the rear cavity to create an X-shape configuration.

Figure 12:
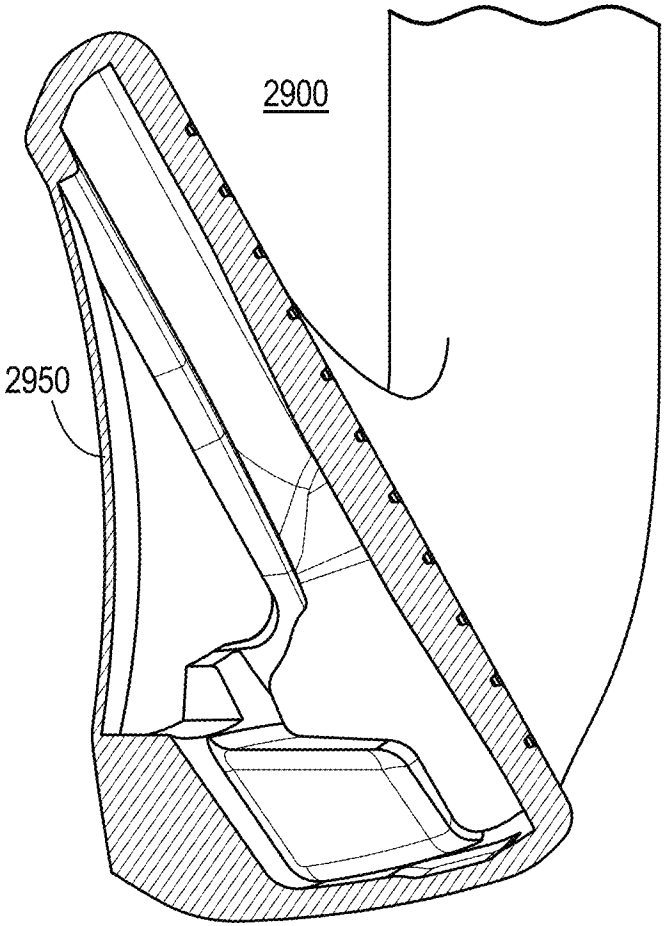
FIG. 12 illustrates a rear view of a golf club head according to an embodiment.

FIG. 12 illustrates a club head 2800 comprising a reinforcing member 2850. The club head 2800 is similar to the club head 2000 described above. The reinforcing members 2850 is concave such that the reinforcing member 2850 bends inwards toward the cavity and towards the strike face.

Figure 13:
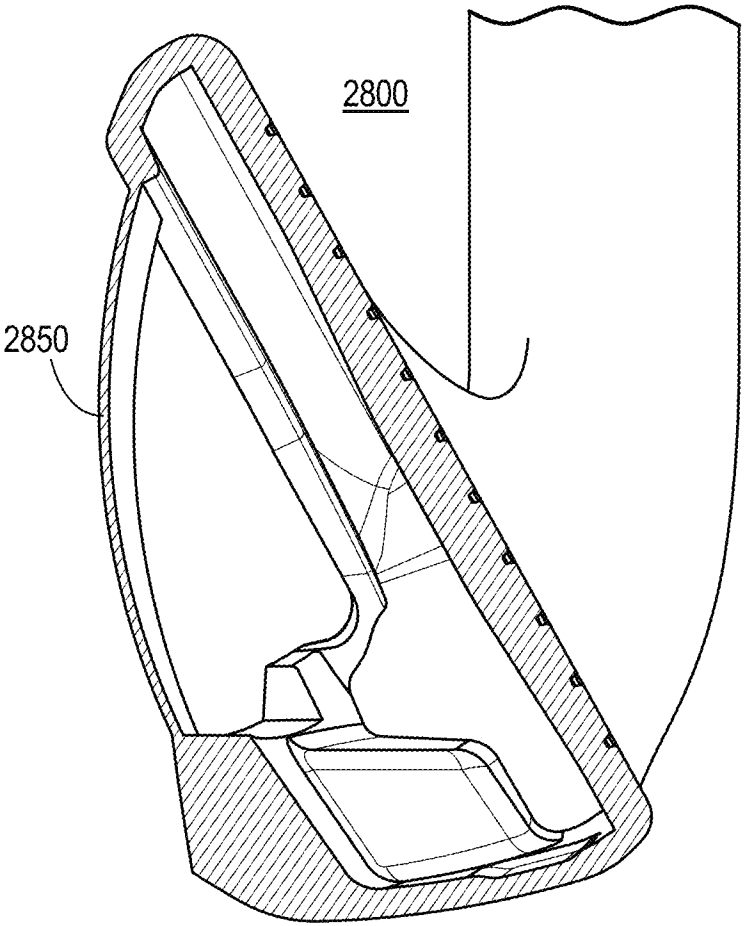
FIG. 13 illustrates a rear view of a golf club head according to an embodiment.

FIG. 13 illustrates a club head 2900 comprising a reinforcing member 2950. The club head 2900 is similar to the club head 2000 described above. The reinforcing members 2950 is convex such that the reinforcing member 2950 bends outwards away from the cavity and away from the strike face.

Each of the reinforcing member embodiments and configurations described above can be concave or convex. Furthermore, the golf club head can comprise a variable face thickness as shown in the figures and a reinforcing member spanning the rear cavity to improve performance, sound, and feel. Even further, the reinforcing member can be used on rear cavity back irons or hollow body irons which comprise a rear opening that is covered to enclose a hollow cavity.

II. Non-Integral Reinforcing Member

Described below is a golf club head comprising an insert and a reinforcing member co-molded to the insert. The co-molded reinforcing member is similar to the integral reinforcing member described above in that both the integral and co-molded reinforcing members provides structural support to the top rail to improve sound, feel, and launch characteristics. The co-molded reinforcing member differs from the integral reinforcing member in that the co-molded reinforcing member is not integrally formed from the club head. The co-molded reinforcing member can be advantageous over integrally forming the reinforcement member due to the ability to easily place an insert within the cavity, further improving damping properties of the club head, and the ability to choose the material of the reinforcing member to achieve improved mass properties and weight distribution. The combination of the co-molded reinforcing member and the insert reduce vibrations and produce a highly desirable sound. Instead, the co-molded reinforcing member is formed separately from the body of the club head and then attached. Co-molding the reinforcing member to the insert can improve ease of manufacturing and assembly of the final golf club head. Specifically, co-molding the reinforcing member to the insert can allow an insert to be placed within the rear cavity and undercut while still providing a reinforcing member spanning the rear cavity to connect to two portions of the perimeter. Co-molding the reinforcing member with the insert increases the reliability of the connection, and the reinforcing member can provide additional support for flexible or limber portions of the perimeter. By providing added support in these flexible or limber locations, the feel, sound and performance of the golf club head can be improved.

Figure 14:
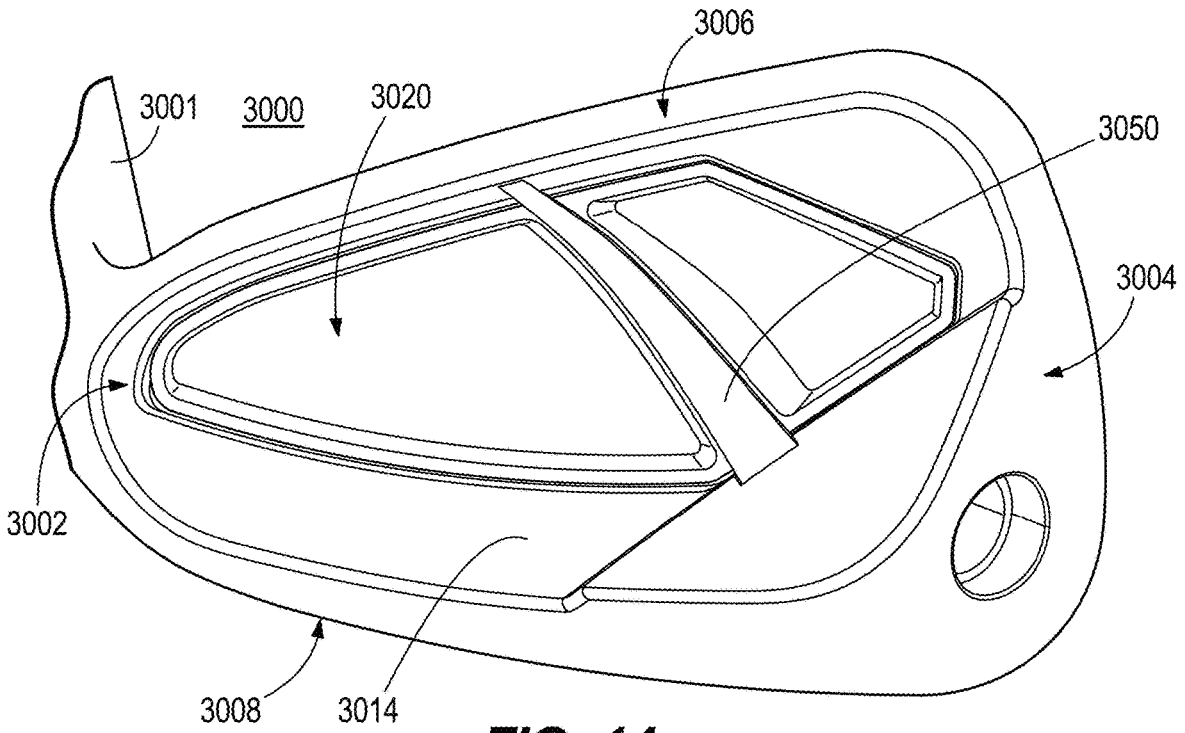
FIG. 14 illustrates a rear view of a golf club head according to an embodiment.
Figure 15:
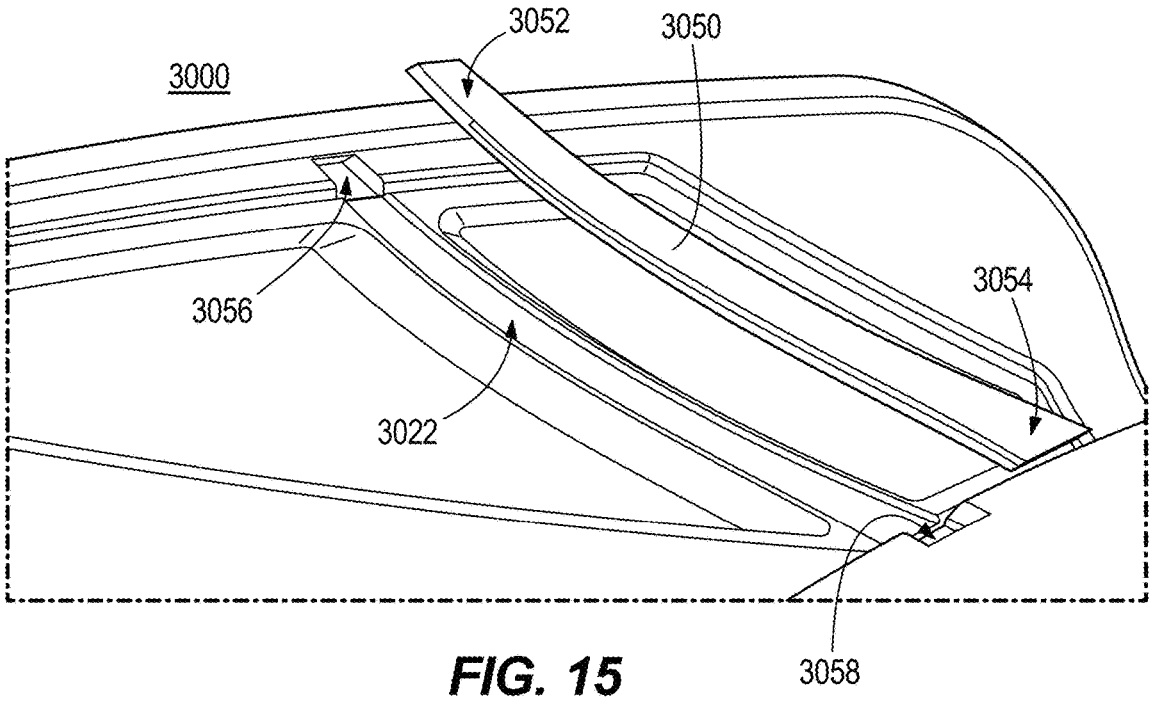
FIG. 15 illustrates an exploded view of the golf club head of FIG. 14.

FIGS. 14 and 15 illustrate a golf club head 3000 according to an embodiment. The golf club head 3000 comprises a striking face, a strike face rear surface, a heel portion 3002, a toe portion 3004 opposite the heel portion 3002, a top rail 3006, a sole 3008 opposite the top rail 3006, a front portion, a rear portion 3014 opposite the front portion, and a hosel 3001 configured to receive a shaft (not shown). The golf club head further comprises a perimeter undercut similar to the perimeter undercut 2015 in the golf club head 2000 described above. The rear portion 3014 extends upward from the sole 3008. The strike face rear surface, the top rail 3006, the sole 3008, the heel portion 3002, and the toe portion 3004 further define a rear cavity. The golf club head 3000 disclosed can be a cavity back iron or a hollow body iron.

The golf club head further comprises an insert 3020 and a reinforcing member 3050 located within the rear cavity. The insert 3020 can be positioned within the rear cavity and can be secured to and/or contact the strike face rear surface. The insert 3020 can span or extend across at least a portion of the rear cavity in a strike face to rear portion 3014 direction. The insert 3020 can further span or extend across at least a portion of the rear cavity in a heel portion 3002 to toe portion 3004 direction. The insert 3020 can be formed from a polymer or flexible material with a low shore durometer (i.e., soft material). The insert can be formed from a polymer matrix. The polymeric matrix can comprise glass-filled elastomer, a stainless steel-filled elastomer, a tungsten-filled elastomer, a thermoplastic polyurethane (TPU) composite, a thermoplastic elastomer (TPE) composite, or any other elastomer matrix composite, a Kevlar® (aramid) fiber-reinforced polymer, a carbon-fiber reinforced polymer, rubber, ethylene-vinyl acetate foam, polymer-based foam, any combination of a suitable resin and a suitable reinforcing fiber, or any combination of the above materials. Soft or flexible materials improve the feel and sound of the golf club head through impact. In one embodiment, the insert 3020 can be connected to the top rail 3006, the rear portion 3014 and the rear surface of the strike face, The reinforcing member 3050 can be co-molded, formed, connected, or secured to the insert.

The durometer of the insert 3020 can range between 20 A to 90 A on the shore A hardness scale. In some embodiments, the durometer is 20 A, 25 A, 30 A, 35 A, 40 A, 45 A, 50 A, 55 A, 60 A, 65 A, 70 A, 75 A, 80 A, 85 A, or 90 A. A lower durometer characterizes a softer material. A softer material is preferred to allow for compressibility of the insert 3020 to be placed within the undercut. Furthermore, a softer material has better vibrational damping capabilities than a harder material.

FIGS. 14 and 15 illustrate the reinforcing member 3050 co-molded with the insert 3020 and secured to the golf club head body 3000. The reinforcing member 3050 can be a rigid member (i.e. formed from metal, plastic, or a composite material) that is secured to the top rail 3006, the insert 3020, and the rear portion 3014. The reinforcing member 3050 can further comprise a first end 3052 located near the top rail 3006, and a second end 3054 located near the rear portion 3014. In one embodiment, the first end 3052 of the reinforcing member 3050 is located closer to a center or center plane of the iron, and the second end 3054 of the reinforcing member 3050 is located closer to the toe portion 3004. In some embodiments, the first end of the reinforcing member 3050 can be attached to at least one of the following sections: top rail 3006, toe portion 3004, heel portion 3002, or rear portion 3014, and the second end of the reinforcing member 3050 can be attached to at least one of the following sections: top rail 3006, toe portion 3004, heel portion 3002, or rear portion 3014. Positioning the reinforcing member 3050 closer to the toe portion 3004 can allow for improvement in ball speed and sound because the reinforcing member 3050 can be supporting an area of the top rail that is more flexible or limber.

In some embodiments, the golf club head can comprise a first reinforcing member and a second reinforcing member. The first reinforcing member and the second reinforcing member are separate and distinct reinforcing members that are approximately parallel to each other. The first and second reinforcing members are angled such that the second end of each member are located more heelward than the first end of the member. The first and second reinforcing members can be spaced any desired distance apart in order to achieve desired damping and mass property adjustment.

In additional embodiments, the first reinforcing member is located on the heel side of the rear cavity and the second reinforcing member is located on the toe side of the rear cavity. The first reinforcing member is separate and distinct from the second reinforcing member such that they do not connect to each other. In this embodiment, the first and second reinforcing members are approximately straight. Furthermore, the first and second reinforcing members are not parallel to each other such that a longitudinal axis running through the length of each of the members would intersect below the club head.

In a further embodiment, the first reinforcing member intersects the second reinforcing member in the rear cavity to create an X-shape configuration.

The reinforcing member can further comprise a reinforcing member length, a reinforcing member width and a reinforcing member thickness. The reinforcing member length can be measured from the first end to the second end. In some embodiments, the reinforcing member length can be between 0.2 inches and 3 inches. In some embodiments, the reinforcing member length can be between 0.2 inch to 0.4 inch, 0.4 inch to 0.6 inch, 0.6 inch to 0.8 inch, 0.8 inch to 1.0 inch, 1.0 inch to 1.2 inches, 1.2 inches to 1.4 inches, 1.4 inches to 1.6 inches, 1.6 inches to 1.8 inches, 1.8 inches to 2.0 inches, 2.0 inches to 2.2 inches, 2.2 inches to 2.4 inches, 2.4 inches to 2.6 inches, 2.6 inches to 2.8 inches, or 2.8 inches to 3.0 inches. In one exemplary embodiment, the reinforcing member length is approximately 1.3 inches.

The reinforcing member width can vary when measured at the first end and at the second end. As such, the measurement can be broken into a first end width and a second end width. The first end width and the second end width can be measured perpendicular to the reinforcing member length in a toeward-to-heelward direction. In some embodiments, the first end width of the reinforcing member can be between 0.04 inch to 0.20 inches. In some embodiments, the first end width of the reinforcing member can be between 0.04 inch to 0.06 inch, 0.06 inch to 0.08 inch, 0.08 inch to 0.10 inch, 010 inch to 0.12 inches, 0.12 inches to 0.14 inches, 0.14 inches to 0.16 inches, 0.16 inches to 0.18 inches, or 0.18 inches to 0.20 inches. In one exemplary embodiment, the first end width of the reinforcing member can be 0.18 inches. In some embodiments, the second end width of the reinforcing member can be between 0.04 inch to 0.06 inch, 0.06 inch to 0.08 inch, 0.08 inch to 0.10 inch, 010 inch to 0.12 inches, 0.12 inches to 0.14 inches, 0.14 inches to 0.16 inches, 0.16 inches to 0.18 inches, or 0.18 inches to 0.20 inches. In one exemplary embodiment, the second end width of the reinforcing member can be 0.04 inch. The reinforcing member width can be constant along the reinforcing member. In one embodiment, the first end width of the reinforcing member can be the same as the second end width of the reinforcing member.

The reinforcing member thickness can be measured between a most rearward reinforcing member surface to a most forward reinforcing member surface when the of the reinforcing member is attached to the golf club head. In some embodiments, the reinforcing member thickness can be between 0.03 inch to 0.07 inch. In some embodiments, the reinforcing member thickness can be between 0.03 inch to 0.04 inch, 0.04 inch to 0.05 inch, 0.05 inch to 0.06 inch, or 0.06 inch to 0.07 inch. In one exemplary embodiment, the reinforcing member thickness is 0.05 inch. The reinforcing member thickness can be constant along the reinforcing member.

Figure 17:
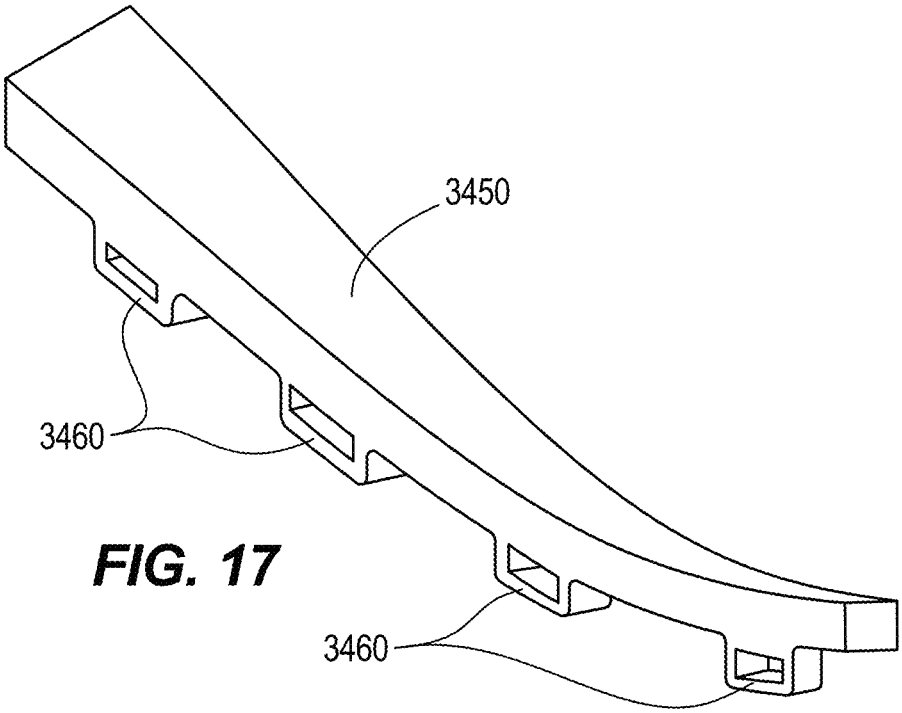
FIG. 17 illustrates an isometric view of a reinforcing member according to an embodiment.

The golf club head 3000 comprises features, such as indentations, on the golf club head body 3000 and the insert 3020 to position the reinforcing member 3050 in specific orientations (i.e. angled orientation from the top rail to the rear portion of the iron). As illustrated in FIG. 17, the golf club head body 3000 comprises locating features 3056, 3022, 3058 to position the reinforcing member 3050 in a desirable zone on the golf club head body 3000. Desirable zones can include flexible or limber portions of the perimeter, such as the top rail 3006 and the rear portion 3014. In one embodiment, the golf club head body 3000 defines a first locating feature 3056 in the top rail 3006 and a second locating feature 3058 in the rear portion 3014. The insert 3020 further defines a third locating feature 3022. The third locating feature 3022 can be an indentation or recess within the insert 3020 spanning the full length of the rear cavity. The locating features 3056, 3022, and 3058 disclosed herein can allow the reinforcing members 3050 to be placed in desirable position to tune the frequencies of the golf club head 3000 during golf ball impact. The first locating feature 3056 and the second locating feature 3058 can comprise an inward recession toward the strike face in the top portion and the rear portion, respectively. The insert locating feature 3022 can be defined by a recess within the insert. In the illustrated embodiment in FIG. 15, the insert comprises a raised portion, relative to an exterior surface of the insert. The locating feature 3022 is recessed in the raised portion to define a channel or indentation. The locating features 3056, 3022, 3058 can further comprise a toeward wall, a heelward wall, and a rearward wall that combine to define the channel or indentation. The channel or indentation can position the reinforcing member in the desired direction. The locating feature 3022 aids in securing the reinforcing member 3050 to the club head body 3000.

Figure 16:
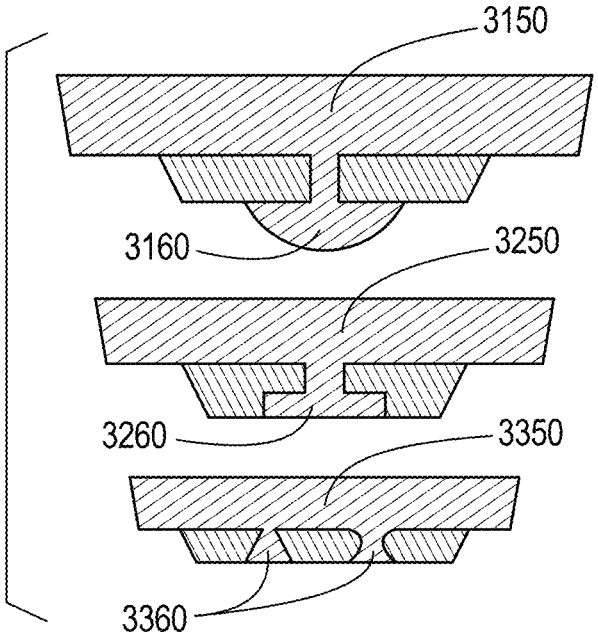
FIG. 16 illustrates a cross-sectional view of a reinforcing according to three embodiments.

The reinforcing member 3050 can comprise various features to improve the connection with the insert 3020. FIG. 16 showcases three possible variations of the locking features. The locking feature can be situated on the most rearward surface of the reinforcing member. The locking features can be any other desirable shape or size to improve the connection of the insert and reinforcing member. The reinforcing member 3150 can comprise a locking feature 3160 that is a rounded protrusion and a stem. The insert is co-molded to surround the locking protrusion 3160. Similarly, reinforcing member 3250 comprises locking feature 3260 that is a T-shaped flange. Further, the reinforcing member 3350 comprises a plurality of locking features 3360 that are dove-tail flanges. During the co-molded process, the insert material is molded around these locking features 3160, 3260, 3360 to improve the connection between the insert and reinforcing member. It is advantageous to include locking features between the insert and the reinforcing member 3150, 3250, 3350 to ensure that the reinforcing member 3150, 3250, 3350 stays secure and attached to the golf club throughout the golf swing. The reinforcing member can comprise a single locking feature or a plurality of locking feature along the length of the reinforcing member.

FIG. 17 illustrates a reinforcing member 3450 comprising a plurality of locking features 3460. The one or more locking features 3460 can help secure the reinforcing member 3450 to the insert. The one or more locking features 3460 can comprise through holes, ledges, dove-tail flanges, or loops. In one embodiment the reinforcing member 3450 can comprise two locking features 3460.

The insert 3020 may be affixed against the rear surface of the strike face. The insert 3020 can be affixed to the golf club head body 3000 via adhesives, tapes, or any other adhesion elements. The insert 3020 may also be press fit into the undercut of the rear cavity to further aid in damping vibrations.

The co-molded reinforcing members described above 3050, 3150, 3250, 3350, 3450 provides advantages over conventional irons that consist of integrally cast reinforcing members. Co-molded reinforcing members 3050, 3150, 3250, 3350, 3450 can be formed from a different material than that of the golf club head body 3000. The reinforcing members 3050, 3150, 3250, 3350, 3450 of the disclosed invention can be formed from a rigid material such as a metal, rigid plastic, or composite material. For example, the reinforcing members 3050, 3150, 3250, 3350, 3450 can be made from magnesium, aluminum, titanium, acetal, acrylic, high-density polyethylene, polypropylene, or a composite matrix. Co-molded reinforcing members 3050, 3150, 3250, 3350, 3450 can precisely tune the frequencies of the golf club head 3000 due to the reinforcing member 3050, 3150, 3250, 3350, 3450 being comprised of a different material from the golf club head. Integrally cast reinforcing members are limited by the use of a single material throughout both the club head body and the reinforcing member. As such, the co-molded reinforcing members 3050, 3150, 3250, 3350, 3450 can comprise a lighter weight and mass when compared to an integral reinforcing member. The lighter weight will help maintain a low and rear center of gravity. The co-molded reinforcing members can also be interchangeable to further adjust weight distribution. The reinforcing member can be formed from a variety of materials that can be switched out depending on the type of weight and stiffness needed.

Additionally, the co-molded reinforcing member 3050, 3150, 3250, 3350, 3450 can improve weight distribution. Specifically, the ability to form the reinforcing member 3050, 3150, 3250, 3350, 3450 from different materials can allow for improved perimeter weighting. In one embodiment, the reinforcing member 3050, 3150, 3250, 3350, 3450 can be formed from a metal material to increase the perimeter weighting. In another embodiment, the reinforcing member 3050, 3150, 3250, 3350, 3450 can be formed from a rigid plastic to reduce the weight in the top rail 3006, and the rear portion 3014 but still maintain desirable frequency tuning capabilities.

Further, the use of a different material for the reinforcing member 3050, 3450 can help to maintain and/or achieve a desired center of gravity location (i.e. using a material that does not shift the CG too high). As described above, an integrally casted reinforcing member could shift the center of gravity to high. The co-molded reinforcing member can made from a different and lighter metal or a rigid plastic to keep the center of gravity in a low and rear position.

A golf club head comprising an insert and co-molded reinforcing member provides improvements to sound, feel, and launch characteristics through the ability to use different materials for each component. The golf club head body can be formed from a first material, the insert can be formed from a second material, and the reinforcing member can be formed from a third material. The first, second and third material can be different from each other. As mentioned above, the insert can be formed from a polymeric material which has improved damping properties due to the soft elastic material and being placed on the rear surface of the strike face. Furthermore, the insert can be placed into the perimeter undercut to aid in damping vibrations along the perimeter. Combing the benefits of the insert with the co-molded reinforcing members creates a club head that maximizes damping properties to significantly improve sound and feel over traditional club heads.

Furthermore, the co-molded reinforcing members 3050, 3150, 3250, 3350, 3450 can take on similar configurations as the reinforcing members depicted in FIGS. 1-13 and described above and be used in conjunction with other aspects and features of the present invention.

Examples

1. Example 1: Modal Analysis on Integral Reinforcing Members

Figure 18A:
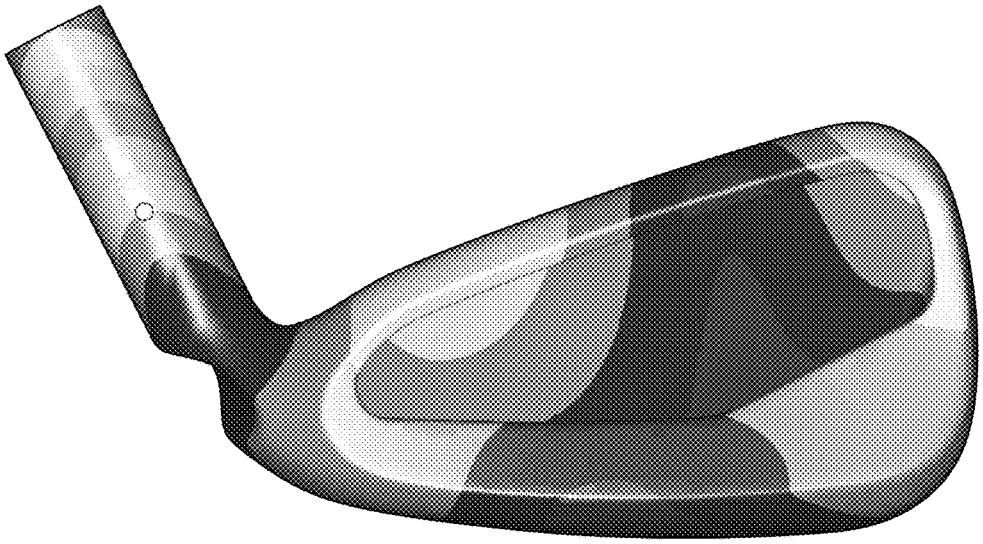
FIG. 18A illustrates modal analysis of Mode 7 of a control club head.
Figure 18B:
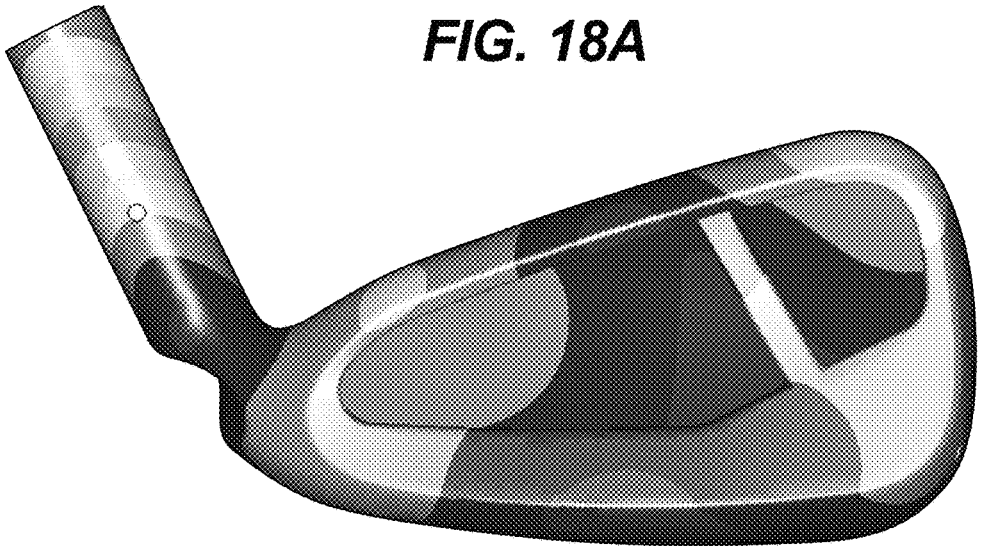
FIG. 18B illustrates modal analysis of Mode 7 of a golf club head according to an embodiment.
Figure 18C:
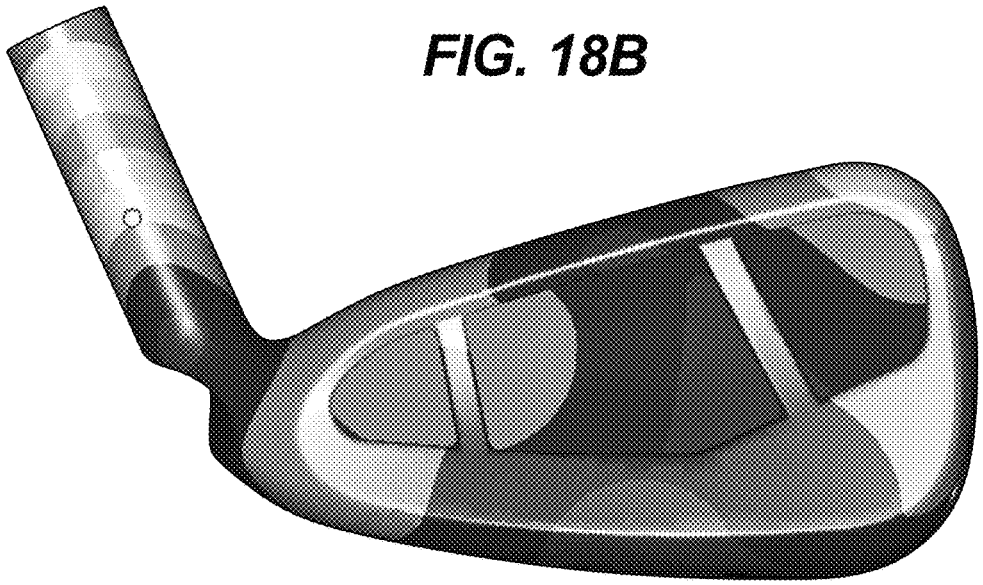
FIG. 18C illustrates modal analysis of Mode 7 of a golf club head according to an embodiment.
Figure 19A:
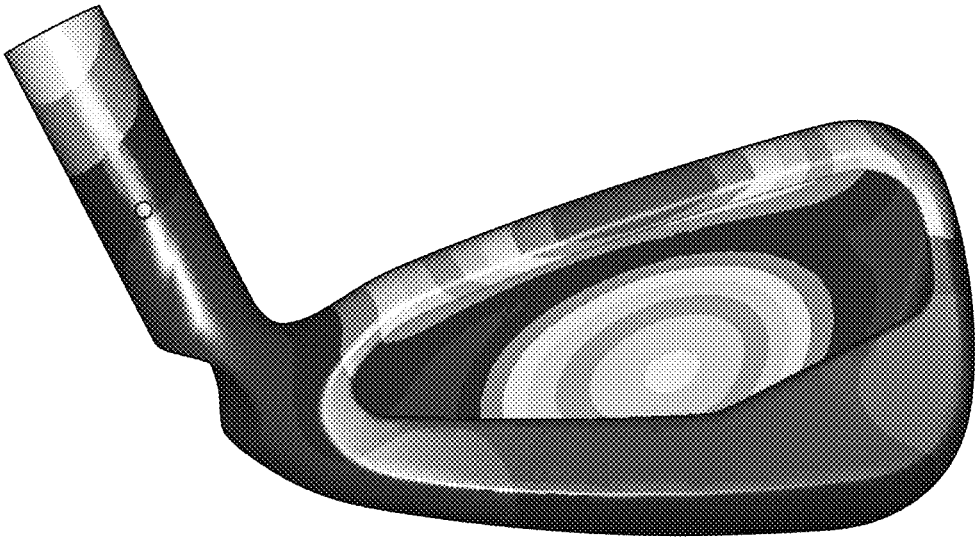
FIG. 19A illustrates modal analysis of Mode 10 of a control club head.
Figure 19B:
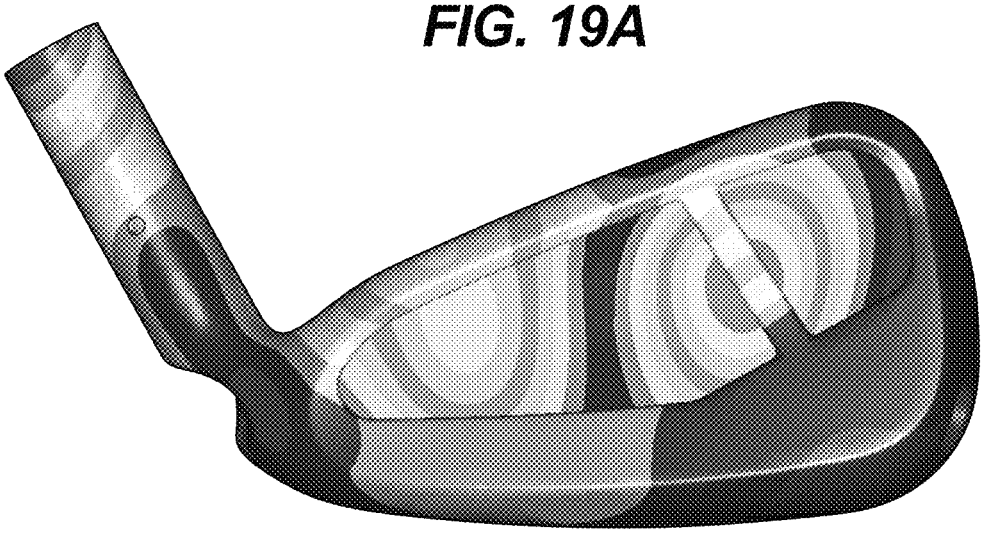
FIG. 19B illustrates modal analysis of Mode 10 of a golf club head according to an embodiment.
Figure 19C:
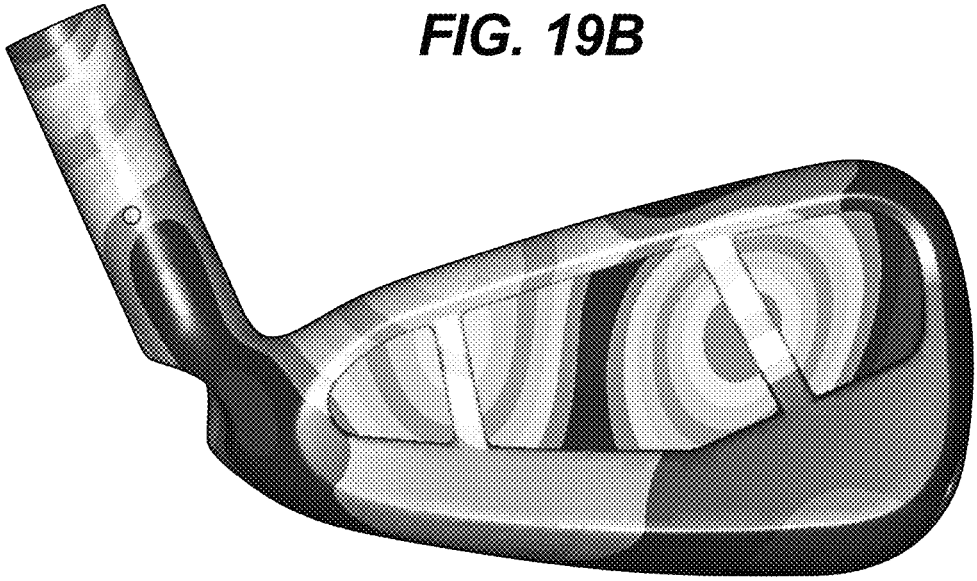
FIG. 19C illustrates modal analysis of Mode 10 of a golf club head according to an embodiment.

FIGS. 18 and 19 illustrate modal analysis results on various examples of irons. The first iron, show in FIGS. 18A and 19A, is a control club head which is a standard cavity back iron that does not comprise any reinforcing structure. The second iron, shown in FIGS. 18B and 19B, is a first exemplary club head according to an embodiment of the present invention. The first exemplary club head comprises one integral reinforcing member. The reinforcing member extends from the sole in a toe portion to the top rail. The third iron, shown in FIGS. 18C and 19C, is a second exemplary club head according to another embodiment of the present invention. The second exemplary club head comprises two reinforcing members. One reinforcing member extends from the perimeter of the sole in a toe portion to the top rail and the second reinforcing member is located on the heel of the golf club and extends from the sole in a heel portion to the top rail. The reinforcing members used in this example span the cavity of the iron and do not touch the strike face.

FIGS. 18A-18C shows a comparative example between the control club head, the first exemplary club head, and the second exemplary club head in Mode 7. Mode 7 is a dominant mode that can be heard when hitting the ball. An improvement (increase frequency) to Mode 7 generally leads to improvements in perceived sound and feel. The control club head, as illustrated in FIG. 18A, had a frequency of about 2484 Hz. The first exemplary club head with one reinforcing member, as illustrated in FIG. 18B, had a frequency of about 2653 Hz. The second exemplary club head with two reinforcing members, as illustrated in FIG. 18C, had a frequency of about 2747 HZ. When compared to the control club head, the first exemplary club head had an increase in frequency of about 169 Hz. When compared to the control club head, the second exemplary club head had an increase in frequency of about 263 Hz. Therefore, the exemplary embodiments show improvements to perceived feel and sound over the control club head.

Furthermore, FIGS. 18A-18C illustrate the amplitude at which regions of the golf club head vibrate in Mode 7. The darker regions indicate higher amplitude, and therefore more movement. Lighter regions indicate lower amplitude, and therefore less movement. The golf club head of FIG. 18A, which lacks a reinforcement member, shows a high amplitude in the top rail. The golf club head of FIG. 18B, which comprises a reinforcement member, shows a lower amplitude in the top rail than the golf club head of FIG. 18A. Similarly, the golf club head of FIG. 18C, which comprises two reinforcement members, shows a lower amplitude in the top rail than the golf club head of FIG. 18A. Therefore, the reinforcement member reduces the amplitude at which the top rail vibrates in Mode 7, thereby improving sound over a golf club head without a reinforcement member.

FIGS. 19A-19C shows another comparative example between the control club head, the first exemplary club head, and the second exemplary club head in Mode 10. Mode 10 is another dominant mode. The control club head, as illustrated in FIG. 19A, had a frequency of about 5775 Hz. The first exemplary club head, as illustrated in FIG. 19B, had a frequency of about 6573 Hz. The second exemplary club head, as illustrated in FIG. 19C, had a frequency of about 6567 Hz. When compared to the control club head, the first exemplary club head had an increase in frequency of about 798 Hz. When compared to the control club head, the second exemplary club head had an increase in frequency of about 792 Hz. Therefore, the exemplary embodiments showed significant improvements to Mode 10.

Furthermore, FIGS. 19A-19C illustrate the amplitude at which regions of the golf club head vibrate in Mode 10. The darker regions indicate higher amplitude, and therefore more movement. Lighter regions indicate lower amplitude, and therefore less movement. The golf club head of FIG. 19A, which lacks a reinforcement member, shows a high amplitude in the top rail. The golf club head of FIG. 19B, which comprises a reinforcement member, shows a lower amplitude in the top rail than the golf club head of FIG. 19A. Similarly, the golf club head of FIG. 19C, which comprises two reinforcement members, shows a lower amplitude in the top rail than the golf club head of FIG. 19A. Therefore, the reinforcement member reduces the amplitude at which the top rail vibrates in Mode 10, thereby improving sound over a golf club without a reinforcement member.

2. Example 2: Golf Club Having Integral Reinforcing Member vs Golf Club Head Without Integral Reinforcing Member Referring to the iron-type golf club head 2000 discussed above and as illustrated in FIGS. 1-4, a comparison was made wherein an iron-type golf club having a reinforcing member was player tested in comparison to a similar iron-type golf club head different only in the comparison iron lacked the reinforcing member 2050. Both golf clubs utilized the same components, build specifications, and were used to hit the same number of shots by each player for the test. Table 2, below, provides the comparison data between an iron-type club head 2000 comprising a reinforcing member 2050 spanning the rear cavity 2013 with a similar iron-type club head without the reinforcing member 2050.

TABLE 2

| Aggregate Average Data | 7-Iron Club Head with Reinforcing Member | 7-Iron Club Head without Reinforcing Member |
|---|---|---|
| Ball Speed (mph) | 125.4 | 125.2 |
| Launch Angle (deg) | 15.1 | 15.3 |
| Spin Rate (rpm) | 5967 | 6138 |
| Max Ball Trajectory Height (yds) | 30.3 | 30.7 |
| Ball Trajectory Landing Angle (deg) | 43.6 | 44.1 |
| Carry Distance (yds) | 180.2 | 179.0 |
| Roll Distance (yds) | 7.2 | 6.7 |

Please note that the ball speed at launch is very similar for both golf clubs. However, the test golf club head having the reinforcing member had a slightly lower launch angle and a spin rate almost 3% lower than the comparison golf club head lacking the reinforcing member. As a result, the ball flight trajectory for the test club had a lower maximum height and lower ball landing angle. This resulted in the test club both carrying further and rolling further, resulting in an average increased total shot distance of almost 2 yards (1.7 yards) vs. the comparison golf club.

Clauses

Clause 1. A golf club head comprising: a body comprising a front end having a strike face, a top rail, a toe, a heel, a sole, and a rear end comprising a rear portion; the strike face comprising a striking surface for impacting a golf ball and a rear surface opposite the striking surface; the strike face further comprising a strike face perimeter and a geometric center a reinforcing element located at the rear surface; wherein: the reinforcing element extends out from the rear surface toward the rear end and away from the front end; the reinforcing element comprises a looped rib having an outer perimeter surface and an inner perimeter surface; the strike face is thinner inside the inner perimeter surface than outside the outer perimeter surface; the outer perimeter surface of the reinforcing elements is filleted with the rear surface; and the inner perimeter surface comprises a largest rib span of greater than or equal to 0.609 centimeters; a strike face perimeter extension extending rearwardly away from the strike face perimeter; the strike face perimeter extension comprising a perimeter extension inner surface and a perimeter extension outer surface; the perimeter extension inner surface and the rear surface of the strike face define a rear cavity; the strike face perimeter extension further comprises a perimeter extension rear wall extending inwardly into the rear cavity; the perimeter extension rear wall comprises a rear wall inner surface and a rear wall outer surface; wherein the rear cavity further comprises a strike face perimeter undercut bounded by the rear wall inner surface, the perimeter extension inner surface, and the rear surface of the strike face; at least one reinforcing member integrally formed with the body spanning the rear cavity connecting to at least two portions of the perimeter extension rear wall.

Clause 2. The golf club head of clause 1, wherein the at least one reinforcing member comprises a material selected from the group consisting of a metal, a rigid plastic, and a TPC.

Clause 3. The golf club head of claim 1, wherein the at least one reinforcing member comprises one reinforcing member.

Clause 4. The golf club head of claim 3, wherein the one reinforcing member comprises a first end adjacent to a first locating feature and a second end adjacent to a second locating feature, the first end of the one reinforcing member is closer to a center of the strike face than the second end of the one reinforcing member.

Clause 5. The golf club head of claim 3, wherein the one reinforcing member comprises a first end adjacent to a first locating feature and a second end adjacent to a second locating feature, and the second end of the one reinforcing member is closer to the toe than the first end of the one reinforcing member.

Clause 6. The golf club head of claim 1, wherein the at least one reinforcing member is not integrally cast with the body of the golf club head.

Clause 7. The golf club head of claim 1, wherein the body is formed from a first material, an insert is formed from a second material, and the at least one reinforcing member is formed from a third material, wherein the first, second, and third materials are different from each other.

Clause 8. The golf club head of claim 7, wherein the insert does not fully enclose the at least one reinforcing member.

Clause 9. The golf club head of claim 7, wherein the insert contacts the rear surface of the strike face, and the insert contacts the rear portion such that the insert extends across the rear cavity.

Clause 10. The golf club head of clause 1, wherein the strike face perimeter extension extends more rearwardly in the sole than in the top rail.

Clause 11. The golf club head of clause 1, wherein the strike face perimeter extension extends more rearwardly in the toe than in the top rail.

Clause 12. The golf club head of clause 1, wherein the strike face perimeter extension extends more rearwardly in the heel than in the top rail.

Clause 13. A golf club head comprising: a body comprising a strike face, a top rail, a toe, a heel, a sole, and a rear portion; the rear portion extending upward from the sole; the strike face comprising a striking surface for impacting a golf ball and a rear surface opposite the striking surface; an insert secured to the rear surface of the strike face; and a reinforcing member; wherein: the insert is affixed to the rear surface via an adhesive; a first locating feature is indented into the top rail; a second locating feature is indented into the rear portion; a third locating feature is indented into the insert; the reinforcing member is configured to be placed into the first locating feature, the second locating feature, and the third locating feature; and the reinforcing member is affixed to the top rail, the insert, and the rear portion via adhesive.

Clause 14. The golf club head of clause 13, wherein the golf club head further comprises a strike face perimeter; and wherein a strike face perimeter extension extends rearwardly away from the strike face perimeter; the strike face perimeter extension comprising a perimeter extension inner surface and a perimeter extension outer surface; the perimeter extension inner surface and the rear surface of the strike face define a rear cavity; the strike face perimeter extension further comprises a perimeter extension rear wall extending inwardly into the rear cavity; the perimeter extension rear wall comprises a rear wall inner surface and a rear wall outer surface; wherein the rear cavity further comprises a strike face perimeter undercut bounded by the rear wall inner surface, the perimeter extension inner surface, and the rear surface of the strike face; at least one reinforcing member integrally formed with the body spanning the rear cavity connecting to at least two portions of the perimeter extension rear wall.

Clause 15. The golf club head of clause 14, wherein the golf club head further comprises an outer surface; wherein the strike face perimeter undercut comprises an undercut wall thickness measured between the outer surface and the perimeter extension inner surface at a point normal to both the outer surface and the perimeter extension inner surface; and wherein the undercut wall thickness is thinner adjacent the top rail than adjacent the sole.

Clause 16. A golf club head comprising: a top end, a bottom end, a toe end, a heel end, a front end, and a rear end; a face element comprising a face surface located at the front end and a rear surface located at the rear end; the face element includes a perimeter region; the face element includes a transition region comprising a varying transition thickness and extending inward from the perimeter region toward a face center; the top end having a top rail extending in a curved manner toward the bottom end to form a top rail wall; the bottom end having a sole and a rear portion that integrally forms with the sole, where the rear portion extends upward toward the top end; wherein the toe end comprises a toe ledge extending in a curved manner between the top rail and rear portion, the toe ledge is integral with the top rail wall and the rear portion; and wherein the heel end comprises a heel ledge extending in a curved manner between the top rail and the rear portion, the heel ledge is integral with the top rail wall and the rear portion; an undercut comprising a first cavity, a second cavity, a third cavity, and a fourth cavity; the first cavity is formed between the rear surface and the top rail wall; the second cavity is formed between the rear surface and the rear portion; the third cavity is formed between the rear surface and the toe ledge; the fourth cavity is formed between the rear surface and the heel ledge; wherein the top rail wall, the rear portion, the toe ledge, and the heel ledge form a portion of a rear perimeter; wherein the rear perimeter defines a central cavity; a reinforcing member that spans the central cavity such that the reinforcing member connects two portions of the rear perimeter.

Clause 17. The golf club head of clause 16, wherein the reinforcing member connects to the top rail and to the rear portion.

Clause 18. The golf club head of clause 16, wherein the reinforcing member connects to the top rail and to the toe ledge.

Clause 19. The golf club head of clause 16, wherein the reinforcing member connects to the top rail and to the heel ledge.

Clause 20. The golf club head of clause 16, wherein the sole extends more rearwardly than the top rail.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to $ocm^3ur$ or become more pronounced, however, are not to be construed as critical, required, or essential features or elements of any or all of the claims, unless such benefits, advantages, solutions, or elements are stated in such claim.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

The invention claimed is:

1. A golf club head comprising:

a body comprising a strike face, a top rail, a toe, a heel, a sole, and a rear portion;

the rear portion extending upward from the sole;

the strike face comprising a striking surface for impacting a golf ball and a rear surface opposite the striking surface;

an insert affixed to the rear surface of the strike face; and a reinforcing member;

wherein:

the insert is affixed to the rear surface of the strike face via an adhesive;

the reinforcing member is co-molded with the insert;

a first locating feature is indented into the top rail;

a second locating feature is indented into the rear portion;

the reinforcing member is configured to be placed into the first locating feature and the second locating feature; and the reinforcing member comprises one or more locking features such that during a molding process, the insert extends through the one or more locking features to secure the reinforcing member to the insert.

2. The golf club head of claim 1, wherein the reinforcing member comprises a material selected from the group consisting of a metal, a rigid plastic, and a TPC.

3. The golf club head of claim 1, wherein the insert further comprises a third locating feature indented into the insert, the reinforcing member is configured to be placed into the third locating feature.

4. The golf club head of claim 1, wherein the reinforcing member comprises a first end adjacent the first locating feature and a second end adjacent the second locating feature, the first end of the reinforcing member is closer to a center of the strike face than the second end of the reinforcing member.

5. The golf club head of claim 1, wherein the reinforcing member comprises a first end adjacent the first locating feature and a second end adjacent the second locating feature, and the second end of the reinforcing member is closer to the toe than the first end of the reinforcing member.

6. The golf club head of claim 1, wherein reinforcing member is not integrally cast with the body of the golf club head.

7. The golf club head of claim 1, wherein the body is formed from a first material, an insert is formed from a second material, and the reinforcing member is formed from a third material, wherein the first, second, and third materials are different from each other.

8. The golf club head of claim 1, wherein the insert does not fully enclose the reinforcing member.

9. The golf club head of claim 1, wherein the insert contacts the rear surface of the strike face and the insert contacts the rear portion such that the insert extends across a rear cavity.

10. The golf club head of claim 1, wherein the first and second locating features comprise an inward recession in the top rail and in the rear portion, respectively.

11. The golf club head of claim 1, wherein the golf club head further comprises a strike face perimeter; wherein a strike face perimeter extension extends rearwardly away from the strike face perimeter;

the strike face perimeter extension comprising a perimeter extension inner surface and a perimeter extension outer surface;

the perimeter extension inner surface and the rear surface of the strike face define a rear cavity;

the strike face perimeter extension further comprises a perimeter extension rear wall extending into the rear cavity;

the perimeter extension rear wall comprises a rear wall inner surface and a rear wall outer surface;

wherein the rear cavity further comprises a strike face perimeter undercut bounded by the rear wall inner surface, the perimeter extension inner surface, and the rear surface of the strike face.

12. The golf club head of claim 11, wherein the strike face perimeter undercut comprises an undercut wall thickness measured between the perimeter extension inner surface and the perimeter extension outer surface, and wherein the perimeter extension rear wall comprises a rear wall thickness measured between the rear wall inner surface and the rear wall outer surface.

13. The golf club head of claim 1, wherein the one or more locking features are chosen from a set of configurations consisting of rounded protrusions and stems, T-shaped flanges, dove-tail flanges, loops, and through holes.

14. The golf club head of claim 4, wherein the reinforcing member further comprises a reinforcing member length, a reinforcing member width, and a reinforcing member thickness;

wherein the reinforcing member length is measured from the first end to the second end;

the reinforcing member width is measured perpendicular to the reinforcing member length in a toeward-to-heelward direction when attached to the golf club head; and wherein the reinforcing member thickness is measured between a most rearward reinforcing member surface to a most forward reinforcing member surface when the reinforcing member is attached to the golf club head.

15. The golf club head of claim 14, wherein the reinforcing member length is in a range of 0.2 inch to 3.0 inches.

16. The golf club head of claim 14, wherein the reinforcing member width is in a range of 0.04 inch to 0.20 inch; and the reinforcing member thickness is in a range of 0.03 inch to 0.07 inch.

17. The golf club head of claim 14, wherein the reinforcing member width and reinforcing member thickness are constant along the reinforcing member length.

18. The golf club head of claim 14, wherein the reinforcing member width and reinforcing member thickness each vary along the reinforcing member length.

19. A golf club head comprising:

a body comprising a strike face having a face center, a top rail, a toe, a heel, a sole, and a rear portion;

the rear portion extending upward from the sole;

the strike face comprising a striking surface having a strike face center for impacting a golf ball and a rear surface opposite the striking surface;

an insert secured to the rear surface of the strike face; and a reinforcing member;

wherein:

the insert is affixed to the rear surface via an adhesive;

a first locating feature is indented into the top rail;

a second locating feature is indented into the rear portion;

a third locating feature is indented into the insert;

the reinforcing member is configured to be placed into the first locating feature, the second locating feature, and the third locating feature; and the reinforcing member is affixed to the top rail, the insert, and the rear portion via adhesive.

20. The golf club head of claim 19, wherein the first and second locating features comprise an inward recession in the top rail and in the rear portion, respectively.

* * * * *